US010427424B2

(12) United States Patent
Creencia et al.

(10) Patent No.: US 10,427,424 B2
(45) Date of Patent: Oct. 1, 2019

(54) ESTIMATING A REMAINING AMOUNT OF A CONSUMABLE RESOURCE BASED ON A CENTER OF MASS CALCULATION

(71) Applicant: Datamax-O'Neil Corporation, Orlando, FL (US)

(72) Inventors: Philamer Villa Creencia, Singapore (SG); Sébastien Michel Marie Joseph d'Armancourt, Singapore (SG); Ananthprasad Babji Subba, Singapore (SG)

(73) Assignee: Datamax-O'Neil Corporation, Orlando, FL (US)

( * ) Notice: Subject to any disclaimer, the term of this patent is extended or adjusted under 35 U.S.C. 154(b) by 0 days.

(21) Appl. No.: 15/800,505

(22) Filed: Nov. 1, 2017

(65) Prior Publication Data

US 2019/0126644 A1 May 2, 2019

(51) Int. Cl.

| | |
|---|---|
| ***B41J 2/00*** | (2006.01) |
| ***B41J 11/00*** | (2006.01) |
| ***B41J 3/407*** | (2006.01) |
| ***B41J 3/36*** | (2006.01) |

(52) U.S. Cl.

CPC ..... *B41J 11/0095* (2013.01); *B41J 3/36* (2013.01); *B41J 3/4075* (2013.01); *B41J 11/0075* (2013.01)

(58) Field of Classification Search

None

See application file for complete search history.

(56) References Cited

U.S. PATENT DOCUMENTS

| | | | |
|---|---|---|---|
| 6,832,725 | B2 | 12/2004 | Gardiner et al. |
| 7,008,125 | B2 | 3/2006 | Nunokawa et al. |
| 7,128,266 | B2 | 10/2006 | Zhu et al. |
| 7,159,783 | B2 | 1/2007 | Walczyk et al. |
| 7,413,127 | B2 | 8/2008 | Ehrhart et al. |
| 7,549,335 | B2 | 6/2009 | Inoue et al. |
| 7,726,575 | B2 | 6/2010 | Wang et al. |
| 8,294,969 | B2 | 10/2012 | Plesko |
| 8,302,896 | B2 | 11/2012 | Iwasaki |
| 8,317,105 | B2 | 11/2012 | Kotlarsky et al. |
| 8,322,622 | B2 | 12/2012 | Liu |
| 8,366,005 | B2 | 2/2013 | Kotlarsky et al. |
| 8,371,507 | B2 | 2/2013 | Haggerty et al. |
| 8,376,233 | B2 | 2/2013 | Van Horn et al. |
| 8,381,979 | B2 | 2/2013 | Franz |
| 8,390,909 | B2 | 3/2013 | Plesko |
| 8,408,464 | B2 | 4/2013 | Zhu et al. |
| 8,408,468 | B2 | 4/2013 | Horn et al. |

(Continued)

FOREIGN PATENT DOCUMENTS

| | | | |
|---|---|---|---|
| JP | 0020726 A | * | 2/2012 |
| WO | 2013163789 A1 | | 11/2013 |

*Primary Examiner* — Matthew Luu
*Assistant Examiner* — Tracey M McMillion
(74) *Attorney, Agent, or Firm* — Additon, Higgins & Pendleton, P.A.

(57) ABSTRACT

Systems and method for estimating a remaining amount of a consumable resource are provided. According to one method, a first step of detecting the center of mass of a mobile printer is conducted, wherein the mobile printer comprises print media. The method may also include a step of determining a remaining print media level based on the detected center of mass.

20 Claims, 5 Drawing Sheets

(56) References Cited

U.S. PATENT DOCUMENTS 8,408,469 B2 4/2013 Good
8,424,768 B2 4/2013 Rueblinger et al.
8,448,863 B2 5/2013 Xian et al.
8,457,013 B2 6/2013 Essinger et al.
8,459,557 B2 6/2013 Havens et al.
8,469,272 B2 6/2013 Kearney
8,474,712 B2 7/2013 Kearney et al.
8,479,992 B2 7/2013 Kotlarsky et al.
8,490,877 B2 7/2013 Kearney
8,517,271 B2 8/2013 Kotlarsky et al.
8,523,076 B2 9/2013 Good
8,528,818 B2 9/2013 Ehrhart et al.
8,544,737 B2 10/2013 Gomez et al.
8,548,420 B2 10/2013 Grunow et al.
8,550,335 B2 10/2013 Samek et al.
8,550,354 B2 10/2013 Gannon et al.
8,550,357 B2 10/2013 Kearney
8,556,174 B2 10/2013 Kosecki et al.
8,556,176 B2 10/2013 Van Horn et al.
8,556,177 B2 10/2013 Hussey et al.
8,559,767 B2 10/2013 Barber et al.
8,561,895 B2 10/2013 Gomez et al.
8,561,903 B2 10/2013 Sauerwein
8,561,905 B2 10/2013 Edmonds et al.
8,565,107 B2 10/2013 Pease et al.
8,571,307 B2 10/2013 Li et al.
8,579,200 B2 11/2013 Samek et al.
8,583,924 B2 11/2013 Caballero et al.
8,584,945 B2 11/2013 Wang et al.
8,587,595 B2 11/2013 Wang
8,587,697 B2 11/2013 Hussey et al.
8,588,869 B2 11/2013 Sauerwein et al.
8,590,789 B2 11/2013 Nahill et al.
8,596,539 B2 12/2013 Havens et al.
8,596,542 B2 12/2013 Havens et al.
8,596,543 B2 12/2013 Havens et al.
8,599,271 B2 12/2013 Havens et al.
8,599,957 B2 12/2013 Peake et al.
8,600,158 B2 12/2013 Li et al.
8,600,167 B2 12/2013 Showering
8,602,309 B2 12/2013 Longacre et al.
8,608,053 B2 12/2013 Meier et al.
8,608,071 B2 12/2013 Liu et al.
8,611,309 B2 12/2013 Wang et al.
8,615,487 B2 12/2013 Gomez et al.
8,621,123 B2 12/2013 Caballero
8,622,303 B2 1/2014 Meier et al.
8,628,013 B2 1/2014 Ding
8,628,015 B2 1/2014 Wang et al.
8,628,016 B2 1/2014 Winegar
8,629,926 B2 1/2014 Wang
8,630,491 B2 1/2014 Longacre et al.
8,635,309 B2 1/2014 Berthiaume et al.
8,636,200 B2 1/2014 Kearney
8,636,212 B2 1/2014 Nahill et al.
8,636,215 B2 1/2014 Ding et al.
8,636,224 B2 1/2014 Wang
8,638,806 B2 1/2014 Wang et al.
8,640,958 B2 2/2014 Lu et al.
8,640,960 B2 2/2014 Wang et al.
8,643,717 B2 2/2014 Li et al.
8,646,692 B2 2/2014 Meier et al.
8,646,694 B2 2/2014 Wang et al.
8,657,200 B2 2/2014 Ren et al.
8,659,397 B2 2/2014 Vargo et al.
8,668,149 B2 3/2014 Good
8,678,285 B2 3/2014 Kearney
8,678,286 B2 3/2014 Smith et al.
8,682,077 B1 3/2014 Longacre
D702,237 S 4/2014 Oberpriller et al.
8,687,282 B2 4/2014 Feng et al.
8,692,927 B2 4/2014 Pease et al.
8,695,880 B2 4/2014 Bremer et al.
8,698,949 B2 4/2014 Grunow et al.
8,702,000 B2 4/2014 Barber et al.
8,717,494 B2 5/2014 Gannon
8,720,783 B2 5/2014 Biss et al.
8,723,804 B2 5/2014 Fletcher et al.
8,723,904 B2 5/2014 Marty et al.
8,727,223 B2 5/2014 Wang
8,740,082 B2 6/2014 Wilz
8,740,085 B2 6/2014 Furlong et al.
8,746,563 B2 6/2014 Hennick et al.
8,750,445 B2 6/2014 Peake et al.
8,752,766 B2 6/2014 Xian et al.
8,756,059 B2 6/2014 Braho et al.
8,757,495 B2 6/2014 Qu et al.
8,760,563 B2 6/2014 Koziol et al.
8,763,909 B2 7/2014 Reed et al.
8,777,108 B2 7/2014 Coyle
8,777,109 B2 7/2014 Oberpriller et al.
8,779,898 B2 7/2014 Havens et al.
8,781,520 B2 7/2014 Payne et al.
8,783,573 B2 7/2014 Havens et al.
8,789,757 B2 7/2014 Barten
8,789,758 B2 7/2014 Hawley et al.
8,789,759 B2 7/2014 Xian et al.
8,794,520 B2 8/2014 Wang et al.
8,794,522 B2 8/2014 Ehrhart
8,794,525 B2 8/2014 Amundsen et al.
8,794,526 B2 8/2014 Wang et al.
8,798,367 B2 8/2014 Ellis
8,807,431 B2 8/2014 Wang et al.
8,807,432 B2 8/2014 Van Horn et al.
8,820,630 B2 9/2014 Qu et al.
8,822,848 B2 9/2014 Meagher
8,824,692 B2 9/2014 Sheerin et al.
8,824,696 B2 9/2014 Braho
8,842,849 B2 9/2014 Wahl et al.
8,844,822 B2 9/2014 Kotlarsky et al.
8,844,823 B2 9/2014 Fritz et al.
8,849,019 B2 9/2014 Li et al.
D716,285 S 10/2014 Chaney et al.
8,851,383 B2 10/2014 Yeakley et al.
8,854,633 B2 10/2014 Laffargue
8,866,963 B2 10/2014 Grunow et al.
8,868,421 B2 10/2014 Braho et al.
8,868,519 B2 10/2014 Maloy et al.
8,868,802 B2 10/2014 Barten
8,868,803 B2 10/2014 Caballero
8,870,074 B1 10/2014 Gannon
8,879,639 B2 11/2014 Sauerwein
8,880,426 B2 11/2014 Smith
8,881,983 B2 11/2014 Havens et al.
8,881,987 B2 11/2014 Wang
8,903,172 B2 12/2014 Smith
8,908,995 B2 12/2014 Benos et al.
8,910,870 B2 12/2014 Li et al.
8,910,875 B2 12/2014 Ren et al.
8,914,290 B2 12/2014 Hendrickson et al.
8,914,788 B2 12/2014 Pettinelli et al.
8,915,439 B2 12/2014 Feng et al.
8,915,444 B2 12/2014 Havens et al.
8,916,789 B2 12/2014 Woodburn
8,918,250 B2 12/2014 Hollifield
8,918,564 B2 12/2014 Caballero
8,925,818 B2 1/2015 Kosecki et al.
8,939,374 B2 1/2015 Jovanovski et al.
8,942,480 B2 1/2015 Ellis
8,944,313 B2 2/2015 Williams et al.
8,944,327 B2 2/2015 Meier et al.
8,944,332 B2 2/2015 Harding et al.
8,950,678 B2 2/2015 Germaine et al.
D723,560 S 3/2015 Zhou et al.
8,967,468 B2 3/2015 Gomez et al.
8,971,346 B2 3/2015 Sevier
8,976,030 B2 3/2015 Cunningham et al.
8,976,368 B2 3/2015 Akel et al.
8,978,981 B2 3/2015 Guan
8,978,983 B2 3/2015 Bremer et al.
8,978,984 B2 3/2015 Hennick et al.
8,985,456 B2 3/2015 Zhu et al.
8,985,457 B2 3/2015 Soule et al.
8,985,459 B2 3/2015 Kearney et al.

(56) References Cited

U.S. PATENT DOCUMENTS

| | | | |
|---|---|---|---|
| 8,985,461 | B2 | 3/2015 | Gelay et al. |
| 8,988,578 | B2 | 3/2015 | Showering |
| 8,988,590 | B2 | 3/2015 | Gillet et al. |
| 8,991,704 | B2 | 3/2015 | Hopper et al. |
| 8,996,194 | B2 | 3/2015 | Davis et al. |
| 8,996,384 | B2 | 3/2015 | Funyak et al. |
| 8,998,091 | B2 | 4/2015 | Edmonds et al. |
| 9,002,641 | B2 | 4/2015 | Showering |
| 9,007,368 | B2 | 4/2015 | Laffargue et al. |
| 9,010,641 | B2 | 4/2015 | Qu et al. |
| 9,015,513 | B2 | 4/2015 | Murawski et al. |
| 9,016,576 | B2 | 4/2015 | Brady et al. |
| D730,357 | S | 5/2015 | Fitch et al. |
| 9,022,288 | B2 | 5/2015 | Nahill et al. |
| 9,030,964 | B2 | 5/2015 | Essinger et al. |
| 9,033,240 | B2 | 5/2015 | Smith et al. |
| 9,033,242 | B2 | 5/2015 | Gillet et al. |
| 9,036,054 | B2 | 5/2015 | Koziol et al. |
| 9,037,344 | B2 | 5/2015 | Chamberlin |
| 9,038,911 | B2 | 5/2015 | Xian et al. |
| 9,038,915 | B2 | 5/2015 | Smith |
| D730,901 | S | 6/2015 | Oberpriller et al. |
| D730,902 | S | 6/2015 | Fitch et al. |
| 9,047,098 | B2 | 6/2015 | Barten |
| 9,047,359 | B2 | 6/2015 | Caballero et al. |
| 9,047,420 | B2 | 6/2015 | Caballero |
| 9,047,525 | B2 | 6/2015 | Barber |
| 9,047,531 | B2 | 6/2015 | Showering et al. |
| 9,049,640 | B2 | 6/2015 | Wang et al. |
| 9,053,055 | B2 | 6/2015 | Caballero |
| 9,053,378 | B1 | 6/2015 | Hou et al. |
| 9,053,380 | B2 | 6/2015 | Xian et al. |
| 9,057,641 | B2 | 6/2015 | Amundsen et al. |
| 9,058,526 | B2 | 6/2015 | Powilleit |
| 9,061,527 | B2 | 6/2015 | Tobin et al. |
| 9,064,165 | B2 | 6/2015 | Havens et al. |
| 9,064,167 | B2 | 6/2015 | Xian et al. |
| 9,064,168 | B2 | 6/2015 | Todeschini et al. |
| 9,064,254 | B2 | 6/2015 | Todeschini et al. |
| 9,066,032 | B2 | 6/2015 | Wang |
| 9,070,032 | B2 | 6/2015 | Corcoran |
| D734,339 | S | 7/2015 | Zhou et al. |
| D734,751 | S | 7/2015 | Oberpriller et al. |
| 9,076,459 | B2 | 7/2015 | Braho et al. |
| 9,079,423 | B2 | 7/2015 | Bouverie et al. |
| 9,080,856 | B2 | 7/2015 | Laffargue |
| 9,082,023 | B2 | 7/2015 | Feng et al. |
| 9,084,032 | B2 | 7/2015 | Rautiola et al. |
| 9,087,250 | B2 | 7/2015 | Coyle |
| 9,092,681 | B2 | 7/2015 | Havens et al. |
| 9,092,682 | B2 | 7/2015 | Wilz et al. |
| 9,092,683 | B2 | 7/2015 | Koziol et al. |
| 9,093,141 | B2 | 7/2015 | Liu |
| 9,098,763 | B2 | 8/2015 | Lu et al. |
| 9,104,929 | B2 | 8/2015 | Todeschini |
| 9,104,934 | B2 | 8/2015 | Li et al. |
| 9,107,484 | B2 | 8/2015 | Chaney |
| 9,111,159 | B2 | 8/2015 | Liu et al. |
| 9,111,166 | B2 | 8/2015 | Cunningham |
| 9,135,483 | B2 | 9/2015 | Liu et al. |
| 9,137,009 | B1 | 9/2015 | Gardiner |
| 9,141,839 | B2 | 9/2015 | Xian et al. |
| 9,147,096 | B2 | 9/2015 | Wang |
| 9,148,474 | B2 | 9/2015 | Skvoretz |
| 9,158,000 | B2 | 10/2015 | Sauerwein |
| 9,158,340 | B2 | 10/2015 | Reed et al. |
| 9,158,953 | B2 | 10/2015 | Gillet et al. |
| 9,159,059 | B2 | 10/2015 | Daddabbo et al. |
| 9,165,174 | B2 | 10/2015 | Huck |
| 9,171,543 | B2 | 10/2015 | Emerick et al. |
| 9,183,425 | B2 | 11/2015 | Wang |
| 9,189,669 | B2 | 11/2015 | Zhu et al. |
| 9,195,844 | B2 | 11/2015 | Todeschini et al. |
| 9,202,458 | B2 | 12/2015 | Braho et al. |
| 9,208,366 | B2 | 12/2015 | Liu |
| 9,208,367 | B2 | 12/2015 | Wangu |
| 9,219,836 | B2 | 12/2015 | Bouverie et al. |
| 9,224,022 | B2 | 12/2015 | Ackley et al. |
| 9,224,024 | B2 | 12/2015 | Bremer et al. |
| 9,224,027 | B2 | 12/2015 | Van Horn et al. |
| D747,321 | S | 1/2016 | London et al. |
| 9,230,140 | B1 | 1/2016 | Ackley |
| 9,235,553 | B2 | 1/2016 | Fitch et al. |
| 9,239,950 | B2 | 1/2016 | Fletcher |
| 9,245,492 | B2 | 1/2016 | Ackley et al. |
| 9,443,123 | B2 | 1/2016 | Hejl |
| 9,248,640 | B2 | 2/2016 | Heng |
| 9,250,652 | B2 | 2/2016 | London et al. |
| 9,250,712 | B1 | 2/2016 | Todeschini |
| 9,251,411 | B2 | 2/2016 | Todeschini |
| 9,258,033 | B2 | 2/2016 | Showering |
| 9,262,633 | B1 | 2/2016 | Todeschini et al. |
| 9,262,660 | B2 | 2/2016 | Lu et al. |
| 9,262,662 | B2 | 2/2016 | Chen et al. |
| 9,269,036 | B2 | 2/2016 | Bremer |
| 9,270,782 | B2 | 2/2016 | Hala et al. |
| 9,274,812 | B2 | 3/2016 | Doren et al. |
| 9,275,388 | B2 | 3/2016 | Havens et al. |
| 9,277,668 | B2 | 3/2016 | Feng et al. |
| 9,280,693 | B2 | 3/2016 | Feng et al. |
| 9,286,496 | B2 | 3/2016 | Smith |
| 9,297,900 | B2 | 3/2016 | Jiang |
| 9,298,964 | B2 | 3/2016 | Li et al. |
| 9,301,427 | B2 | 3/2016 | Feng et al. |
| 9,304,376 | B2 | 4/2016 | Anderson |
| 9,310,609 | B2 | 4/2016 | Rueblinger et al. |
| 9,313,377 | B2 | 4/2016 | Todeschini et al. |
| 9,317,037 | B2 | 4/2016 | Byford et al. |
| D757,009 | S | 5/2016 | Oberpriller et al. |
| 9,342,723 | B2 | 5/2016 | Liu et al. |
| 9,342,724 | B2 | 5/2016 | McCloskey |
| 9,361,882 | B2 | 6/2016 | Ressler et al. |
| 9,365,381 | B2 | 6/2016 | Colonel et al. |
| 9,373,018 | B2 | 6/2016 | Colavito et al. |
| 9,375,945 | B1 | 6/2016 | Bowles |
| 9,378,403 | B2 | 6/2016 | Wang et al. |
| D760,719 | S | 7/2016 | Zhou et al. |
| 9,360,304 | B2 | 7/2016 | Chang et al. |
| 9,383,848 | B2 | 7/2016 | Daghigh |
| 9,384,374 | B2 | 7/2016 | Bianconi |
| 9,390,596 | B1 | 7/2016 | Todeschini |
| D762,604 | S | 8/2016 | Fitch et al. |
| 9,411,386 | B2 | 8/2016 | Sauerwein |
| 9,412,242 | B2 | 8/2016 | Van Horn et al. |
| 9,418,269 | B2 | 8/2016 | Havens et al. |
| 9,418,270 | B2 | 8/2016 | Van Volkinburg et al. |
| 9,423,318 | B2 | 8/2016 | Lui et al. |
| D766,244 | S | 9/2016 | Zhou et al. |
| 9,443,222 | B2 | 9/2016 | Singel et al. |
| 9,454,689 | B2 | 9/2016 | McCloskey et al. |
| 9,464,885 | B2 | 10/2016 | Lloyd et al. |
| 9,465,967 | B2 | 10/2016 | Xian et al. |
| 9,478,113 | B2 | 10/2016 | Xie et al. |
| 9,478,983 | B2 | 10/2016 | Kather et al. |
| D771,631 | S | 11/2016 | Fitch et al. |
| 9,481,186 | B2 | 11/2016 | Bouverie et al. |
| 9,488,986 | B1 | 11/2016 | Solanki |
| 9,489,782 | B2 | 11/2016 | Payne et al. |
| 9,490,540 | B1 | 11/2016 | Davies et al. |
| 9,491,729 | B2 | 11/2016 | Rautiola et al. |
| 9,497,092 | B2 | 11/2016 | Gomez et al. |
| 9,507,974 | B1 | 11/2016 | Todeschini |
| 9,519,814 | B2 | 12/2016 | Cudzilo |
| 9,521,331 | B2 | 12/2016 | Bessettes et al. |
| 9,530,038 | B2 | 12/2016 | Xian et al. |
| 9,531,235 | B2 | 12/2016 | Rothkopf et al. |
| D777,166 | S | 1/2017 | Bidwell et al. |
| 9,558,386 | B2 | 1/2017 | Yeakley |
| 9,572,901 | B2 | 2/2017 | Todeschini |
| 9,606,581 | B1 | 3/2017 | Howe et al. |
| D783,601 | S | 4/2017 | Schulte et al. |
| D785,617 | S | 5/2017 | Bidwell et al. |
| D785,636 | S | 5/2017 | Oberpriller et al. |
| 9,646,189 | B2 | 5/2017 | Lu et al. |

(56) References Cited

U.S. PATENT DOCUMENTS 9,646,191 B2 5/2017 Unemyr et al.
9,652,648 B2 5/2017 Ackley et al.
9,652,653 B2 5/2017 Todeschini et al.
9,656,487 B2 5/2017 Ho et al.
9,659,198 B2 5/2017 Giordano et al.
D790,505 S 6/2017 Vargo et al.
D790,546 S 6/2017 Zhou et al.
9,680,282 B2 6/2017 Hanenburg
9,697,401 B2 7/2017 Feng et al.
9,701,140 B1 7/2017 Alaganchetty et al.
2006/0028491 A1* 2/2006 Horrocks ..... G09G 5/24 345/649
2007/0063048 A1 3/2007 Havens et al.
2009/0134221 A1 5/2009 Zhu et al.
2010/0177076 A1 7/2010 Essinger et al.
2010/0177080 A1 7/2010 Essinger et al.
2010/0177707 A1 7/2010 Essinger et al.
2010/0177749 A1 7/2010 Essinger et al.
2011/0169999 A1 7/2011 Grunow et al.
2011/0202554 A1 8/2011 Powilleit et al.
2012/0111946 A1 5/2012 Golant
2012/0168512 A1 7/2012 Kotlarsky et al.
2012/0193423 A1 8/2012 Samek
2012/0203647 A1 8/2012 Smith
2012/0223141 A1 9/2012 Good et al.
2012/0224905 A1* 9/2012 Nihashi ..... B41J 11/0075 400/583
2013/0043312 A1 2/2013 Van Horn
2013/0075168 A1 3/2013 Amundsen et al.
2013/0175341 A1 7/2013 Kearney et al.
2013/0175343 A1 7/2013 Good
2013/0257744 A1 10/2013 Daghigh et al.
2013/0257759 A1 10/2013 Daghigh
2013/0270346 A1 10/2013 Xian et al.
2013/0292475 A1 11/2013 Kotlarsky et al.
2013/0292477 A1 11/2013 Hennick et al.
2013/0293539 A1 11/2013 Hunt et al.
2013/0293540 A1 11/2013 Laffargue et al.
2013/0306728 A1 11/2013 Thuries et al.
2013/0306731 A1 11/2013 Pedraro
2013/0307964 A1 11/2013 Bremer et al.
2013/0308625 A1 11/2013 Park et al.
2013/0313324 A1 11/2013 Koziol et al.
2013/0332524 A1 12/2013 Fiala et al.
2014/0001267 A1 1/2014 Giordano et al.
2014/0002828 A1 1/2014 Laffargue et al.
2014/0025584 A1 1/2014 Liu et al.
2014/0100813 A1 1/2014 Showering
2014/0034734 A1 2/2014 Sauerwein
2014/0039693 A1 2/2014 Havens et al.
2014/0049120 A1 2/2014 Kohtz et al.
2014/0049635 A1 2/2014 Laffargue et al.
2014/0061306 A1 3/2014 Wu et al.
2014/0063289 A1 3/2014 Hussey et al.
2014/0066136 A1 3/2014 Sauerwein et al.
2014/0067692 A1 3/2014 Ye et al.
2014/0070005 A1 3/2014 Nahill et al.
2014/0071840 A1 3/2014 Venancio
2014/0074746 A1 3/2014 Wang
2014/0076974 A1 3/2014 Havens et al.
2014/0078342 A1 3/2014 Li et al.
2014/0098792 A1 4/2014 Wang et al.
2014/0100774 A1 4/2014 Showering
2014/0103115 A1 4/2014 Meier et al.
2014/0104413 A1 4/2014 McCloskey et al.
2014/0104414 A1 4/2014 McCloskey et al.
2014/0104416 A1 4/2014 Giordano et al.
2014/0106725 A1 4/2014 Sauerwein
2014/0108010 A1 4/2014 Maltseff et al.
2014/0108402 A1 4/2014 Gomez et al.
2014/0108682 A1 4/2014 Caballero
2014/0110485 A1 4/2014 Toa et al.
2014/0114530 A1 4/2014 Fitch et al.
2014/0125853 A1 5/2014 Wang
2014/0125999 A1 5/2014 Longacre et al.
2014/0129378 A1 5/2014 Richardson
2014/0131443 A1 5/2014 Smith
2014/0131444 A1 5/2014 Wang
2014/0133379 A1 5/2014 Wang et al.
2014/0136208 A1 5/2014 Maltseff et al.
2014/0140585 A1 5/2014 Wang
2014/0152882 A1 6/2014 Samek et al.
2014/0158770 A1 6/2014 Sevier et al.
2014/0159869 A1 6/2014 Zumsteg et al.
2014/0166755 A1 6/2014 Liu et al.
2014/0166757 A1 6/2014 Smith
2014/0168787 A1 6/2014 Wang et al.
2014/0175165 A1 6/2014 Havens et al.
2014/0191913 A1 7/2014 Ge et al.
2014/0197239 A1 7/2014 Havens et al.
2014/0197304 A1 7/2014 Feng et al.
2014/0204268 A1 7/2014 Grunow et al.
2014/0214631 A1 7/2014 Hansen
2014/0217166 A1 8/2014 Berthiaume et al.
2014/0217180 A1 8/2014 Liu
2014/0231500 A1 8/2014 Ehrhart et al.
2014/0247315 A1 9/2014 Marty et al.
2014/0263493 A1 9/2014 Amurgis et al.
2014/0263645 A1 9/2014 Smith et al.
2014/0270196 A1 9/2014 Braho et al.
2014/0270229 A1 9/2014 Braho
2014/0278387 A1 9/2014 DiGregorio
2014/0282210 A1 9/2014 Bianconi
2014/0288933 A1 9/2014 Braho et al.
2014/0297058 A1 10/2014 Barker et al.
2014/0299665 A1 10/2014 Barber et al.
2014/0351317 A1 11/2014 Smith et al.
2014/0362184 A1 12/2014 Jovanovski et al.
2014/0363015 A1 12/2014 Braho
2014/0369511 A1 12/2014 Sheerin et al.
2014/0374483 A1 12/2014 Lu
2014/0374485 A1 12/2014 Xian et al.
2015/0001301 A1 1/2015 Ouyang
2015/0009338 A1 1/2015 Laffargue et al.
2015/0014416 A1 1/2015 Kotlarsky et al.
2015/0021397 A1 1/2015 Rueblinger et al.
2015/0028104 A1 1/2015 Ma et al.
2015/0029002 A1 1/2015 Yeakley et al.
2015/0032709 A1 1/2015 Maloy et al.
2015/0039309 A1 2/2015 Braho et al.
2015/0040378 A1 2/2015 Saber et al.
2015/0049347 A1 2/2015 Laffargue et al.
2015/0051992 A1 2/2015 Smith
2015/0053769 A1 2/2015 Thuries et al.
2015/0062366 A1 3/2015 Liu et al.
2015/0063215 A1 3/2015 Wang
2015/0088522 A1 3/2015 Hendrickson et al.
2015/0096872 A1 4/2015 Woodburn
2015/0100196 A1 4/2015 Hollifield
2015/0115035 A1 4/2015 Meier et al.
2015/0127791 A1 5/2015 Kosecki et al.
2015/0128116 A1 5/2015 Chen et al.
2015/0133047 A1 5/2015 Smith et al.
2015/0134470 A1 5/2015 Hejl et al.
2015/0136851 A1 5/2015 Harding et al.
2015/0142492 A1 5/2015 Kumar
2015/0144692 A1 5/2015 Hejl
2015/0144698 A1 5/2015 Teng et al.
2015/0149946 A1 5/2015 Benos et al.
2015/0161429 A1 6/2015 Xian
2015/0186703 A1 7/2015 Chen et al.
2015/0199957 A1 7/2015 Funyak et al.
2015/0210199 A1 7/2015 Payne
2015/0220753 A1 8/2015 Zhu et al.
2015/0254485 A1 9/2015 Feng et al.
2015/0310243 A1 10/2015 Ackley
2015/0310389 A1 10/2015 Crimm et al.
2015/0327012 A1 11/2015 Bian et al.
2016/0014251 A1 1/2016 Hejl
2016/0040982 A1 2/2016 Li et al.
2016/0042241 A1 2/2016 Todeschini
2016/0057230 A1 2/2016 Todeschini et al.
2016/0062473 A1 3/2016 Bouchat et al.
2016/0092805 A1 3/2016 Geisler et al.

(56) References Cited

U.S. PATENT DOCUMENTS

2016/0101936 A1 4/2016 Chamberlin
2016/0102975 A1 4/2016 McCloskey et al.
2016/0104019 A1 4/2016 Todeschini et al.
2016/0104274 A1 4/2016 Jovanovski et al.
2016/0109219 A1 4/2016 Ackley et al.
2016/0109220 A1 4/2016 Laffargue
2016/0109224 A1 4/2016 Thuries et al.
2016/0112631 A1 4/2016 Ackley et al.
2016/0112643 A1 4/2016 Laffargue et al.
2016/0117627 A1 4/2016 Raj et al.
2016/0124516 A1 5/2016 Schoon et al.
2016/0125217 A1 5/2016 Todeschini
2016/0125342 A1 5/2016 Miller et al.
2016/0133253 A1 5/2016 Braho et al.
2016/0171597 A1 6/2016 Todeschini
2016/0171666 A1 6/2016 McCloskey
2016/0171720 A1 6/2016 Todeschini
2016/0171775 A1 6/2016 Todeschini et al.
2016/0171777 A1 6/2016 Todeschini et al.
2016/0174674 A1 6/2016 Oberpriller et al.
2016/0178479 A1 6/2016 Goldsmith
2016/0178685 A1 6/2016 Young et al.
2016/0178707 A1 6/2016 Young et al.
2016/0179132 A1 6/2016 Harr et al.
2016/0179143 A1 6/2016 Bidwell et al.
2016/0179368 A1 6/2016 Roeder
2016/0179378 A1 6/2016 Kent et al.
2016/0180130 A1 6/2016 Bremer
2016/0180133 A1 6/2016 Oberpriller et al.
2016/0180136 A1 6/2016 Meier et al.
2016/0180594 A1 6/2016 Todeschini
2016/0180663 A1 6/2016 McMahan et al.
2016/0180678 A1 6/2016 Ackley et al.
2016/0180713 A1 6/2016 Bernhardt et al.
2016/0185136 A1 6/2016 Ng et al.
2016/0185291 A1 6/2016 Chamberlin
2016/0186926 A1 6/2016 Oberpriller et al.
2016/0188861 A1 6/2016 Todeschini
2016/0188939 A1 6/2016 Sailors et al.
2016/0188940 A1 6/2016 Lu et al.
2016/0188941 A1 6/2016 Todeschini et al.
2016/0188942 A1 6/2016 Good et al.
2016/0188943 A1 6/2016 Linwood
2016/0188944 A1 6/2016 Wilz et al.
2016/0189076 A1 6/2016 Mellott et al.
2016/0189087 A1 6/2016 Morton et al.
2016/0189088 A1 6/2016 Pecorari et al.
2016/0189092 A1 6/2016 George et al.
2016/0189284 A1 6/2016 Mellott et al.
2016/0189288 A1 6/2016 Todeschini
2016/0189366 A1 6/2016 Chamberlin et al.
2016/0189443 A1 6/2016 Smith
2016/0189447 A1 6/2016 Valenzuela
2016/0189489 A1 6/2016 Au et al.
2016/0191684 A1 6/2016 DiPiazza et al.
2016/0192051 A1 6/2016 DiPiazza et al.
2016/0125873 A1 7/2016 Braho et al.
2016/0202951 A1 7/2016 Pike et al.
2016/0202958 A1 7/2016 Zabel et al.
2016/0202959 A1 7/2016 Doubleday et al.
2016/0203021 A1 7/2016 Pike et al.
2016/0203429 A1 7/2016 Mellott et al.
2016/0203797 A1 7/2016 Pike et al.
2016/0203820 A1 7/2016 Zabel et al.
2016/0204623 A1 7/2016 Haggert et al.
2016/0204636 A1 7/2016 Allen et al.
2016/0204638 A1 7/2016 Miraglia et al.
2016/0316190 A1 7/2016 McCloskey et al.
2016/0227912 A1 8/2016 Oberpriller et al.
2016/0232891 A1 8/2016 Pecorari
2016/0292477 A1 10/2016 Bidwell
2016/0294779 A1 10/2016 Yeakley et al.
2016/0306769 A1 10/2016 Kohtz et al.
2016/0314276 A1 10/2016 Sewell et al.
2016/0314294 A1 10/2016 Kubler et al.
2016/0323310 A1 11/2016 Todeschini et al.
2016/0325677 A1 11/2016 Fitch et al.
2016/0327614 A1 11/2016 Young et al.
2016/0327930 A1 11/2016 Charpentier et al.
2016/0328762 A1 11/2016 Pape
2016/0330218 A1 11/2016 Hussey et al.
2016/0343163 A1 11/2016 Venkatesha et al.
2016/0343176 A1 11/2016 Ackley
2016/0364914 A1 12/2016 Todeschini
2016/0370220 A1 12/2016 Ackley et al.
2016/0372282 A1 12/2016 Bandringa
2016/0373847 A1 12/2016 Vargo et al.
2016/0377414 A1 12/2016 Thuries et al.
2016/0377417 A1 12/2016 Jovanovski et al.
2017/0010141 A1 1/2017 Ackley
2017/0010328 A1 1/2017 Mullen et al.
2017/0010780 A1 1/2017 Waldron et al.
2017/0016714 A1 1/2017 Laffargue et al.
2017/0018094 A1 1/2017 Todeschini
2017/0046603 A1 2/2017 Lee et al.
2017/0047864 A1 2/2017 Stang et al.
2017/0053146 A1 2/2017 Liu et al.
2017/0053147 A1 2/2017 Geramine et al.
2017/0053647 A1 2/2017 Nichols et al.
2017/0055606 A1 3/2017 Xu et al.
2017/0060316 A1 3/2017 Larson
2017/0061961 A1 3/2017 Nichols et al.
2017/0064634 A1 3/2017 Van Horn et al.
2017/0083730 A1 3/2017 Feng et al.
2017/0091502 A1 3/2017 Furlong et al.
2017/0091706 A1 3/2017 Lloyd et al.
2017/0091741 A1 3/2017 Todeschini
2017/0091904 A1 3/2017 Ventress
2017/0092908 A1 3/2017 Chaney
2017/0094238 A1 3/2017 Germaine et al.
2017/0098947 A1 4/2017 Wolski
2017/0100949 A1 4/2017 Celinder et al.
2017/0108838 A1 4/2017 Todeschini et al.
2017/0108895 A1 4/2017 Chamberlin et al.
2017/0118355 A1 4/2017 Wong et al.
2017/0123598 A1 5/2017 Phan et al.
2017/0124369 A1 5/2017 Rueblinger et al.
2017/0124396 A1 5/2017 Todeschini et al.
2017/0124687 A1 5/2017 McCloskey et al.
2017/0126873 A1 5/2017 McGary et al.
2017/0126904 A1 5/2017 d'Armancourt et al.
2017/0139012 A1 5/2017 Smith
2017/0140329 A1 5/2017 Bernhardt et al.
2017/0140731 A1 5/2017 Smith
2017/0147847 A1 5/2017 Berggren et al.
2017/0150124 A1 5/2017 Thuries
2017/0169198 A1 6/2017 Nichols
2017/0171035 A1 6/2017 Lu et al.
2017/0171703 A1 6/2017 Maheswaranathan
2017/0171803 A1 6/2017 Maheswaranathan
2017/0180359 A1 6/2017 Wolski et al.
2017/0180577 A1 6/2017 Nguon et al.
2017/0181299 A1 6/2017 Shi et al.
2017/0190192 A1 7/2017 Delario et al.
2017/0193432 A1 7/2017 Bernhardt
2017/0193461 A1 7/2017 Jonas et al.
2017/0193727 A1 7/2017 Van Horn et al.
2017/0200108 A1 7/2017 Au et al.
2017/0200275 A1 7/2017 McCloskey et al.

* cited by examiner

ESTIMATING A REMAINING AMOUNT OF A CONSUMABLE RESOURCE BASED ON A CENTER OF MASS CALCULATION

FIELD OF THE INVENTION

The present invention relates to systems and methods for determining a remaining amount of a consumable resource, such as print media, and more particularly relates to determining the remaining amount based on a center of mass calculation.

BACKGROUND

Generally, mobile printers allow a user to print labels and other print media while on the move. For instance, mobile printers may be used in a warehouse environment, in a retail setting, in the transportation industry, and in other environments where users might not be confined to an office but may instead be required to perform activities, including printing, in many different locations.

When a user is moving around within an area and performing multiple printing jobs, the user may be unaware that the mobile printer may be running out of paper, labels, or other print media on which the mobile printer may be designed to print. When the print media is used up, the user may be required to reload more print media into the mobile printer. However, it can be time-consuming and/or inconvenient for the user if the print media runs out when the user is far from a supply of replacement media. Therefore, a need exists for communicating to the user of a mobile printer when the print media is empty, almost empty, or below a certain threshold.

SUMMARY

Accordingly, in one aspect, the present invention embraces systems and methods for calculating center of mass of a device (e.g., mobile printer). From the center of mass calculations, a remaining amount of a consumable resource (e.g., paper) can be calculated. The remaining amount of the consumable resource can be calculated by comparing the center of mass reading with pre-established reference points that represent center of mass points when the device is full or empty.

In an exemplary embodiment, a method is provided for estimating the remaining amount of consumable resource. The method includes detecting the center of mass of a mobile printer, where the mobile printer comprises print media. The method also includes determining a remaining print media level based on the detected center of mass.

In another exemplary embodiment, a printer is described. The printer includes a housing and a printing mechanism mounted within the housing. The printing mechanism is configured to print onto a print media. The printer further includes a media level detection module mounted with the housing. The media level detection module is configured to detect the center of mass of the printer. The media level detection module is further configured to determine a remaining print media level based on the detected center of mass of the printer.

In yet another exemplary embodiment, a device configured to use a consumable resource is provided. The device includes a housing that includes a containment area where the consumable resource is to be stored. The device further includes a detection module configured to detect the center of mass of the device and determine a remaining level of the consumable resource based on the detected center of mass.

The foregoing illustrative summary, as well as other exemplary objectives and/or advantages of the invention, and the manner in which the same are accomplished, are further explained within the following detailed description and its accompanying drawings.

DETAILED DESCRIPTION

The present invention embraces systems and methods for sensing the amount of a consumable resource (e.g., print media) that remains within a device (e.g., a mobile printer). The remaining amount of the resource can be measured using an accelerometer and/or gyroscopic sensor to determine the center of mass of the mobile printer at different times during the use of the mobile printer. As the print media is consumed, the mobile printer not only loses overall mass but also experiences a change in its center of mass or center of gravity. Since the print media by itself is usually not centered within a housing of the mobile printer, the change in mass of the print media as it is consumed thereby changes the center of mass of the mobile printer.

Furthermore, the mobile printer may be configured to store reference points that define the extremes of the locations of the center of mass with respect to a housing in which the print media is contained. The stored reference points may include an initial location of the center of mass when the mobile printer contains a new full roll of print media. This initial location can be regarded as being the location of the center of mass when the print media is "full." Also, the mobile printer may also be configured to store an ending location, which represents the location of the center of mass of the mobile printer when the print media has been completely used up. This ending location can be regarded as being the location of the center of mass when the print media is "empty."

Some mobile printers may already include an accelerometer and/or gyroscopic sensor for determining orientation and dynamic positional states of the device. The present invention may also utilize these elements for making center of mass calculations. The accelerometer and/or gyroscopic sensor can measure approximate weight of the mobile printer, which may also be used to estimate the amount of print media left in the mobile printer. In addition to mobile printers, some embodiments may include incorporating an accelerometer and/or gyroscopic sensor in a stationary printer that may be moved occasionally. In this respect, for stationary printers that may be moved for printing at different locations, the embodiments disclosed herein may also to these printers as well.

The main contributors to the weight of a mobile printer are typically the battery and the print media. As the print media is consumed due to printing operations, the concentration of the weight or center of mass is shifted. The accelerometer and/or gyroscopic sensor readings will vary with the changes in the center of mass. Furthermore, the center of mass calculations can be correlated with the amount of print media remaining in the mobile printer. Thus, as the print media is consumed, the center of mass gradually moves from a first point (when the print media is full) to a second point (when the print media is empty).

Figure 1:
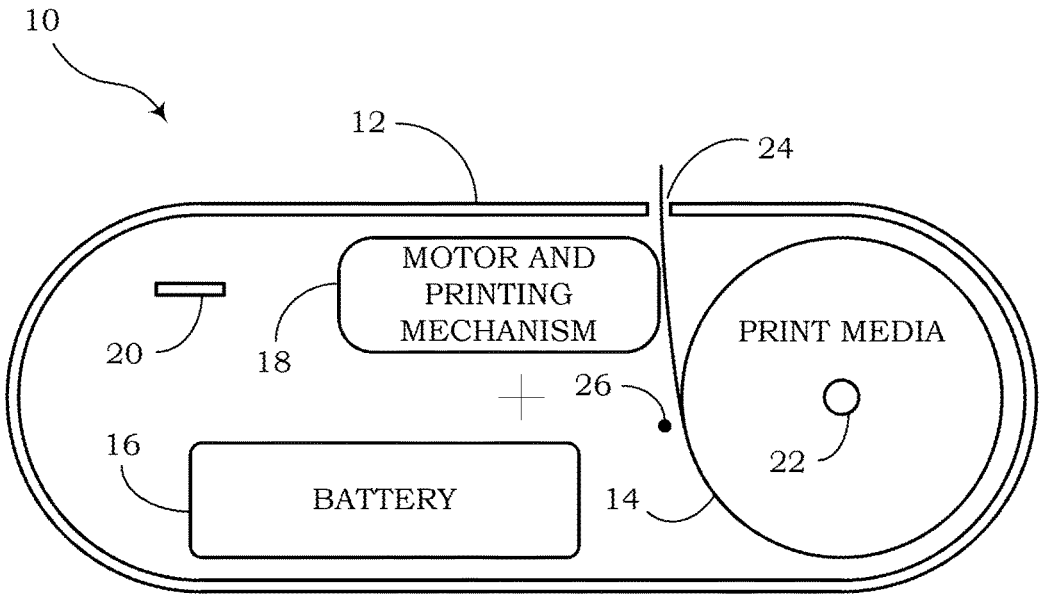
FIG. 1 schematically depicts a cross-sectional side view of a first mobile printer arranged in a horizontal orientation when the print media is full, according to one embodiment of the present invention.

FIG. 1 is a cross-sectional side view of an embodiment of a mobile printer 10 having a housing 12. It should be noted that the shape and size of the housing 12 may differ based on the specific design. Consequently, center of mass calculations are affected by the characteristics of the housing 12. As described herein for the purpose of determining the amount of the remaining consumable resource, the center of mass measurements may be conducted for each particular design of the housing 12 or other various housings.

The mobile printer 10 is illustrated in a condition when print media 14 within the housing 12 of the mobile printer 10 is full. In addition to the print media 14, one or more batteries 16, a motor and printing mechanism 18, and a media level detection module 20 are contained within the housing 12 of the mobile printer 10.

Figure 2:
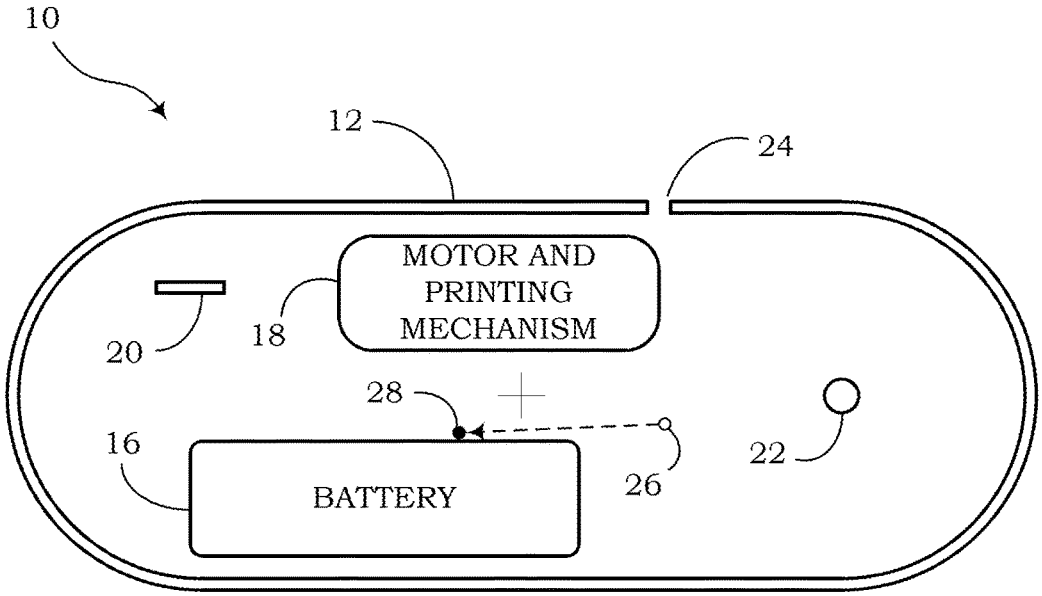
FIG. 2 schematically depicts a cross-sectional side view of the first mobile printer of FIG. 1 when the print media is empty, according to one embodiment of the present invention.

The media level detection module 20 may include a microelectromechanical system (MEMS) or other suitable detecting elements for detecting center of mass. In some embodiments, the media level detection module 20 may further include or have access to memory for storing reference points corresponding to full and empty conditions of the consumable resource. For example, the MEMS or media level detection module 20 may include an accelerometer and/or a gyroscopic sensor. The media level detection module 20 may also be configured for determining whether the mobile printer 10 is in a horizontal orientation or a vertical orientation. As illustrated in FIGS. 1 and 2, the mobile printer 10 is oriented in a horizontal configuration, and in FIGS. 3 and 4, the mobile printer 10 is shown as being oriented in a vertical position, which may be a common orientation when attached to a belt of a user.

The housing 12 and each of the internal components of the mobile printer 10 naturally includes a certain mass. It should be recognized, however, that the mass of most of the components does not change significantly over time. However, during use, the print media 14 is consumed until the print media 14 eventually runs out and must be replaced with a new roll. Therefore, the overall mass of the mobile printer 10 gradually declines with use of the print media 14.

The various masses of the different components of the mobile printer 10 contribute to a point representing the center of mass (or center of gravity) that may not necessarily be consistent with the center of mass of the housing 12. For instance, certain components, such as the print media 14 and battery 16 may have a greater mass that contributes more significantly to the overall center of mass of the mobile printer 10 than other components of the mobile printer 10. And, as mentioned above, the print media 14 is gradually consumed, which consequently results in a shift of the center of mass of the mobile device 10 from one extreme point (i.e., when the print media 14 is "full") to another extreme point (i.e., when the print media 14 is "empty").

As shown in FIG. 1, the print media 14 is in a full state. The print media 14 is contained within an area of the housing 12 by a peg 22 or shaft, pin, spool, or other means for maintaining the print media 14 within the designated area. An end of the print media 14 is led through an output slot 24 in the housing 12.

During a manufacturing process, reference points that serve to represent the locations of the center of mass points in at least the two extreme conditions can be calculated. The first extreme condition is the full condition when the print media is completely full. For example, using the media level detection module 20, the center of mass of the mobile printer 10 can be calculated to determine the "full" point 26. As an example, the center of mass may be determined to be at the point 26, which is shown slightly off center of the geometrical center of the housing 12. The contribution of the mass of the print media 14 may shift the center of mass of the housing 12 and its contents in the direction of the print media 14.

FIG. 2 is a cross-sectional side view showing an embodiment of the mobile printer 10 of FIG. 1 when the print media 14 is empty. When the print media 14 is completely consumed, the empty spool 22 or other various media distribution elements may be left. During manufacture, the media level detection module 20 may be used to obtain a center of mass measurement at a time when the print media 14 is absent. In this example, it may be determined that the center of mass of the mobile printer 10 has been shifted to a final point 28. Without the presence of the print media 14, the contributions of the battery 16 and motor and printing mechanism 18 to the overall mass may provide a center of mass more closely located near these components. Again, this final center of mass point 26 may be slightly off center from the geographical center of the housing 12.

Theoretically, the center of mass point changes from the initial point 26 to the final point 28 in a linear manner. However, in some circumstances, the change in the center of mass may follow a non-linear, curved path. Also, the amount of change of the center of mass per unit of print media consumed may increase or decrease based on various factors and/or unknowns in the device.

Figure 3:
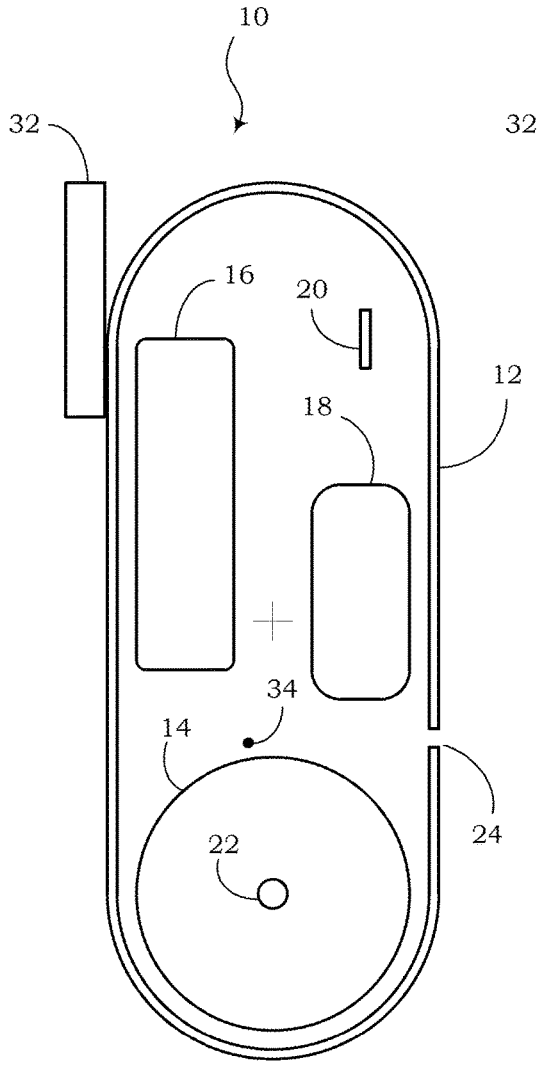
FIG. 3 schematically depicts a cross-sectional side view of the first mobile printer of FIG. 1 arranged in a vertical orientation when the print media is full, according to one embodiment of the present invention.
Figure 4:
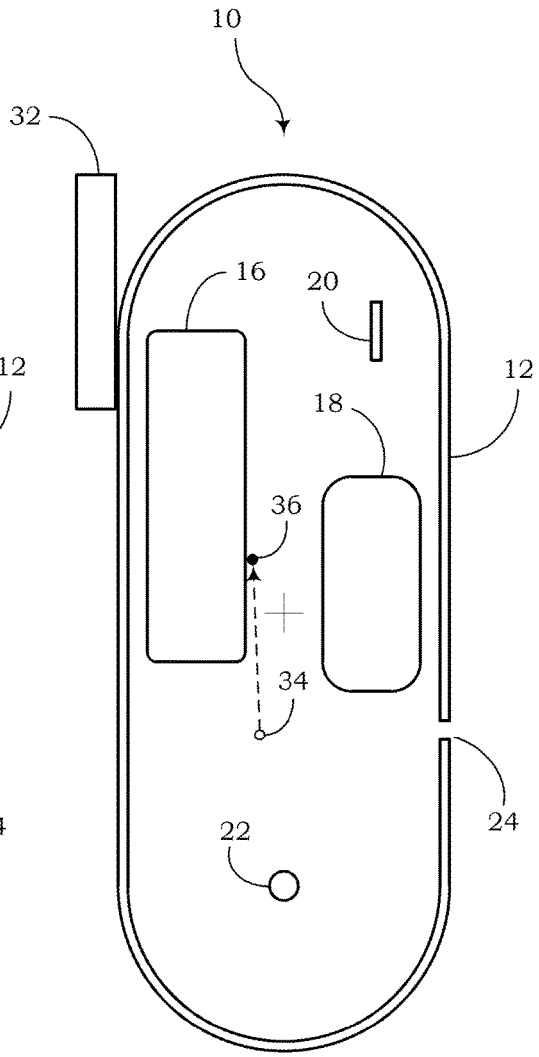
FIG. 4 schematically depicts a cross-sectional side view of the first mobile printer of FIG. 3 when the print media is empty, according to one embodiment of the present invention.

FIG. 3 is a cross-sectional side view showing an embodiment of the mobile printer 10 arranged in a vertical orientation when the print media is full. FIG. 4 is a cross-sectional side view showing an embodiment of the mobile printer of FIG. 3 when the print media is empty. In the embodiment of FIGS. 3 and 4, however, the mobile printer 10 may further include a belt clip 32, which may be configured to be attached to a belt worn by the user of the mobile printer 10.

When positioned in the vertical orientation, the mobile printer 10 may include a first reference point 34 related to the center of mass of the mobile printer 10 when the print media 14 is full. Also, the mobile printer 10 may include a second reference point 36 related to the center of mass of the mobile printer 10 when the print media 14 is empty.

As mentioned above, the print media 14 is confined by the peg 22. Although the peg 22 may be configured to substantially maintain the print media 14 in the designated area within the housing 12, the effect of gravity may slightly alter the center of mass readings. Therefore, during manufacture, the reference points for indicating the positions of the center of mass at the extreme conditions of the print media 14 can be calculated when the mobile printer 10 is also configured in the vertical position. Another component that may slightly alter the center of mass readings is the belt clip 32.

For these reasons, it may be advantageous to determine at least four center of mass points for each specific mobile printer design. The first center of mass point 26 may be calculated to represent the condition when the print media 14 is full and the mobile printer 10 is oriented horizontally (FIG. 1). The second center of mass point 28 may be calculated to represent the condition when the print media 14 is empty and the mobile printer 10 is oriented horizontally (FIG. 2). The third center of mass point 34 may be calculated to represent the condition when the print media 14 is full and the mobile printer 10 is oriented vertically (FIG. 3). And the fourth center of mass point 36 may be calculated to represent the condition when the print media 14 is empty and the mobile printer 10 is oriented vertically (FIG. 4). Again, these points may be calculated before the mobile printer 10 is put into use, such as during a time when the mobile printer 10 is being manufactured or during a calibration process.

When the mobile printer 10 is put into use, the media level detection module 20 may be configured to determine the center of mass of the mobile printer 10. The media level detection module 20 may also detect the orientation of the mobile printer 10. Based on these factors, the media level detection module 20 can compare the current center of mass point with the pre-stored reference points (i.e., 26, 28, 34, 36). By comparing with these and/or other additional reference points, the media level detection module 20 can estimate how much of the print media 14 remains. In some embodiments, the media level detection module 20 can provide an indication to the user when the print media 14 drops below a certain threshold.

According to some embodiments, the media level detection module 20 may alternatively be installed in the housing of another type of device that contains a consumable resource other than print media. For example, some devices may use various types of consumable resources, such as paper, labels, solid or liquid fuels, ammunition, or other resources that when used will essentially alter the center of mass of the respective device. The respective housing of the various devices may include chambers, tanks, or other designated areas where the consumable resource is stored. Throughout the use of the device, the consumable resource is consumed. As the consumable resource is consumed, the overall mass of that resource will naturally decrease from an initial mass representing a full condition to a final mass representing an empty condition.

According to some embodiments, the mobile printer 10 may include various types of components for indicating a remaining amount of the print media 14 and/or for indicating when the amount of the print media 14 falls below certain thresholds. In some embodiments, a graduated gauge may be used for indicating an amount of print media 14 remaining in the mobile printer 10. The media level detection module 20 may utilize a processing device, such as a microprocessor, for comparing a current center of mass measurement with pre-stored reference points. For example, if a center of mass measurement is determined to be halfway between full and empty conditions, the processing device may be configured to conclude that the consumable resource is about half full.

According to various embodiments, the center of mass calculations may be used to indicate fractions or percentages of the remaining resource. For example, if the center of mass is calculated as being ⅞ths of the distance from a "full" center of mass location (e.g., point 26) to an "empty" center of mass location (e.g., point 28), then the processing device may determine that the consumable resource is approximately ⅛ths full. If it is determined that the consumable resource drops below a certain threshold (e.g., below ⅛ full, below 10%, below 5%, etc.), then an alert indication can be provided to the user. The alert indication may include, for example, the illumination of a light emitting diode (LED) or other visual indicator, an audio output, a display message on a user screen, and/or other various types of indications. In some embodiments, a wireless signal may be transmitted from the mobile printer 10 to a remote device or server to provide an indication of the amount of print media remaining.

For example, some indications may include a first LED that is illuminated to show that the consumable resource is below a certain threshold. The LED, for example, may be a specific color, such as yellow. Additionally, another LED may be used to indicate a more urgent condition, such as when the consumable resource drops below an even lower threshold. This second LED, for example, may be another color, such as red.

In other embodiments, an indication device may be used to show a more gradual decrease in the amount of consumable resource remaining. For instance, a graduated gauge may be used. A needle or other marking or indicating device (mechanical and/or electrical) may be used for indicating an amount ranging from "E" to "F" or from 0% to 100%.

It should be noted that the use of an accelerometer and/or gyroscopic sensor may require that the mobile printer 10 be in motion, at least around the time that the measurements are made. Otherwise, the media level detection module 20 may not be able to calculate parameters that rely on a mechanical force (e.g., gravitational force).

Figure 5:
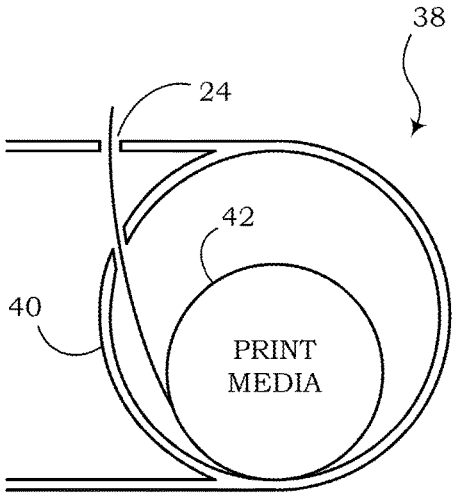
FIG. 5 schematically depicts a cross-sectional side view of a portion of a second mobile printer arranged in a horizontal orientation when the print media is between full and empty, according to one embodiment of the present invention.

FIG. 5 is a cross-sectional side view showing a portion of a second mobile printer 38 arranged in a horizontal orientation. The second mobile printer 38 may include many of the same features as described with respect to FIGS. 1-4. However, instead of containing the peg 22 shown in FIGS. 1-4, the second mobile printer 38 includes a cylindrical compartment 40. The cylindrical compartment 40 is configured to contain the print media 42, which in this embodiment does not necessarily include a center spool around which the media is wrapped.

Without means for centering the print media 42 within the cylindrical compartment 40, the print media 42 may be allowed to move freely within the cylindrical compartment 40. It should be noted that as the print media 42 is consumed, the center of mass of the print media 42 will also shift within the cylindrical compartment 40, particularly based on the orientation of the mobile device 38. FIG. 5 shows a condition when the print media 42 is between full and empty. Because of gravity, when the mobile printer 38 is oriented in the horizontal orientation as shown in FIG. 5, the print media 42 will settle on the bottom, thereby adjusting the center of mass of the mobile printer 38 downward.

Figure 6:
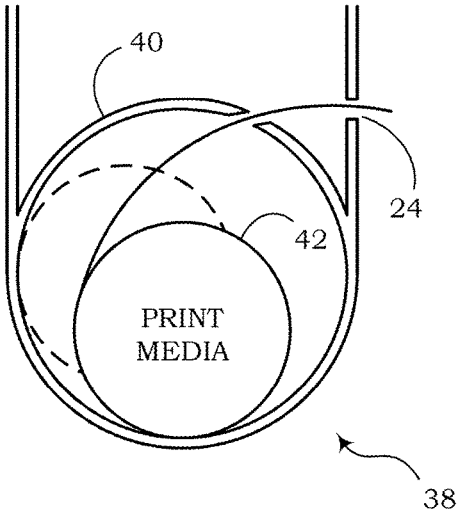
FIG. 6 schematically depicts a cross-sectional side view of the portion of the second mobile printer of FIG. 5 arranged in a vertical orientation, according to one embodiment of the present invention.

FIG. 6 is a cross-sectional side view of the portion of the second mobile printer 38 of FIG. 5 arranged in a vertical orientation. The print media 42 again is shown in a state between full and empty. As the print media 42 is consumed, the center of mass calculations for the mobile printer 38 will be slightly different from those calculations made when the mobile printer 38 is oriented horizontally. The difference between the center of mass calculations from the horizontal orientation (FIG. 5) to the vertical orientation (FIG. 6) may be due to the positioning of the print media 42 within the cylindrical compartment 40.

As mentioned above with respect to FIGS. 1-4, initial readings can be conducted before the mobile printer 38 is put into use. These initial readings can be used to establish reference points that later readings can be compared to. Also, the initial measurements can be conducted and then stored for a mobile printer positioned both in a horizontal orientation and a vertical orientation. Then, during use, the media level detection module 20 (not shown in FIGS. 5 and 6) may be configured to determine the current center of mass and compare this measurement to the reference points to estimate the remaining amount of print media 42.

Figure 7:
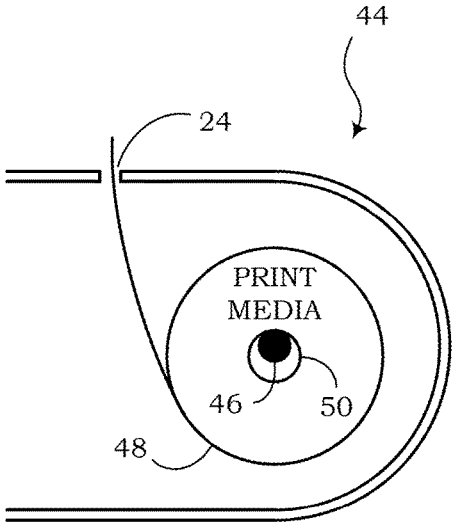
FIG. 7 schematically depicts a cross-sectional side view of a portion of a third mobile printer arranged in a horizontal orientation when the print media is between full and empty, according to one embodiment of the present invention.

FIG. 7 is a cross-sectional side view of a portion of a third mobile printer 44 arranged in a horizontal orientation. The third mobile printer 44 includes a post 46 around which the print media 48 can rotate. In this embodiment, print media 48 includes an inner tube 50 that fits around the post 46. The inner tube 50 in this embodiment may have an inner diameter that is larger than the outer diameter of the post 46, thereby allowing the print media 48 to rotate freely. In FIG. 7, the print media 48 is shown when it is between a completely full condition and a completely empty condition.

Figure 8:
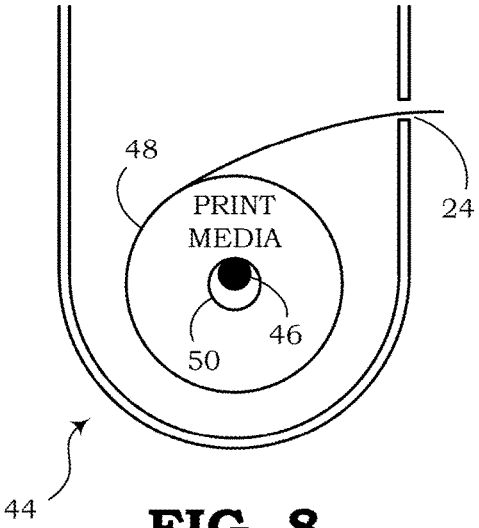
FIG. 8 schematically depicts a cross-sectional side view of the portion of the third mobile printer of FIG. 7 arranged in a vertical orientation, according to one embodiment of the present invention.

FIG. 8 schematically depicts a cross-sectional side view of the portion of the third mobile printer 44 of FIG. 7 arranged in a vertical orientation. Because of the way gravity acts on the print media 48 when the mobile printer 44 is oriented in the horizontal orientation (FIG. 7) and in the vertical orientation (FIG. 8), the center of mass measurements will differ slightly. Therefore, initial reference points may be obtained when the mobile printer 44 is oriented horizontally and vertically. Then, based on center of mass calculations during use of the mobile device 44 and based on the calculated orientation, a current center of mass point can be compared with the reference points to estimate the remaining amount of print media 48.

Figure 9:
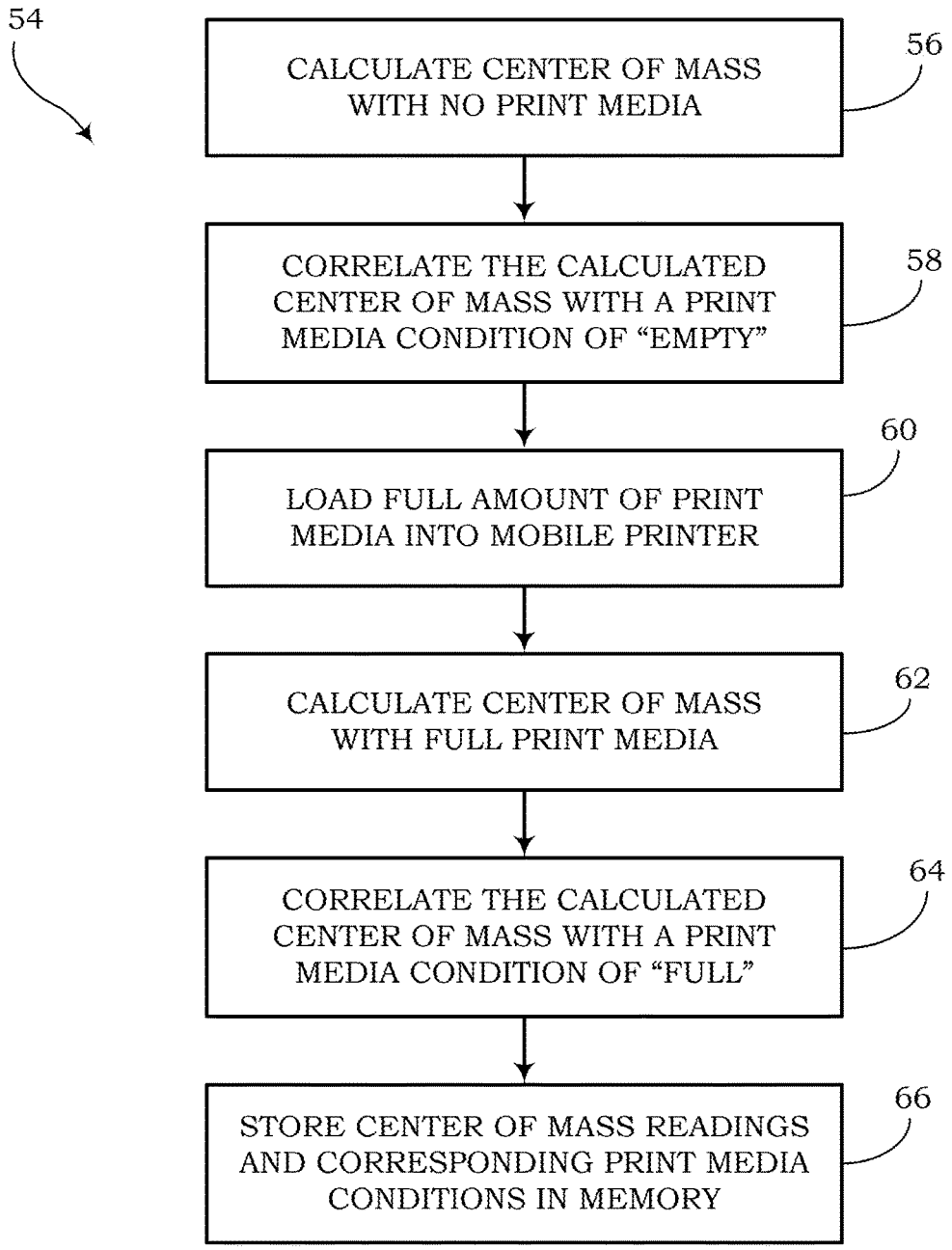
FIG. 9 schematically depicts a flow diagram of a method for establishing a correlation between center of mass points and full and empty conditions of the print media, according to one embodiment of the present invention.

FIG. 9 is a flow diagram showing an embodiment of a method 54 for establishing a correlation between center of mass points and full and empty conditions of the print media. For example, the method 54 may be conducted during a manufacturing process or a calibration or recalibration process after the mobile printer has been constructed. Therefore, the method 54 may be executed before the mobile printer is put into use.

It should be noted that the method 54 of FIG. 9 may represent the correlation of center of mass points with remaining amounts when a mobile printer is oriented in one particular manner (e.g., horizontally). The method 54 may also be repeated for determining additional correlations when the mobile printer is in a different orientation (e.g., vertically).

Method 54 includes a first step of calculating the center of mass of the mobile printer with no print media included, as indicated in block 56. This center of mass point is correlated with a condition of the print media being "empty," as indicated in block 58.

The method 54 also includes a step of properly loading a full amount (e.g., full roll) of the print media into the mobile printer, as indicated in block 60. In some embodiments, the method 54 may alternatively include adding a weight other than an actual roll of print media to the interior of the mobile printer. For example, the weight may be configured to mimic the size, mass, and weight distribution of an actual full roll of print media.

With a full amount of print media (or substitute weight), the method 54 includes the step of calculating, according to block 62, the center of mass of the mobile printer a second time. Also, the method 54 includes correlating the calculated center of mass of the full mobile printer with a print media condition of "full," as indicated in block 64.

In addition, the method 54 includes storing the center of mass readings (i.e., obtained in blocks 56 and 62) and the corresponding print media conditions (i.e., obtained in blocks 58 and 64). The center of mass and corresponding media conditions can be stored in memory, which may preferably be contained within the housing of the mobile printer.

In some embodiments, the method 54 may also include calculating one or more additional center of mass points corresponding to conditions in which the print media may be in state between a full amount and an empty amount. By establishing additional points, the mobile printer, during use, may be configured to more easily indicate multiple threshold levels that may fall between the two extremes of full and empty.

The method 54 may also include steps to account for differences in various types of print media that may be installed in the printer 10, 38, 44. For example, print media types may differ with respect to mass or density. If this is the case, the center of mass calculations can be made for each type of media. Then, the user can inform the printer what type of media is installed and the parameters for that type of media can be used for correlating center of mass with remaining print media. Therefore, the steps related to blocks 60, 62, and 64 may include repeating the processes of determining center of mass when full for each type of print media that may be installed in the printer.

Figure 10:
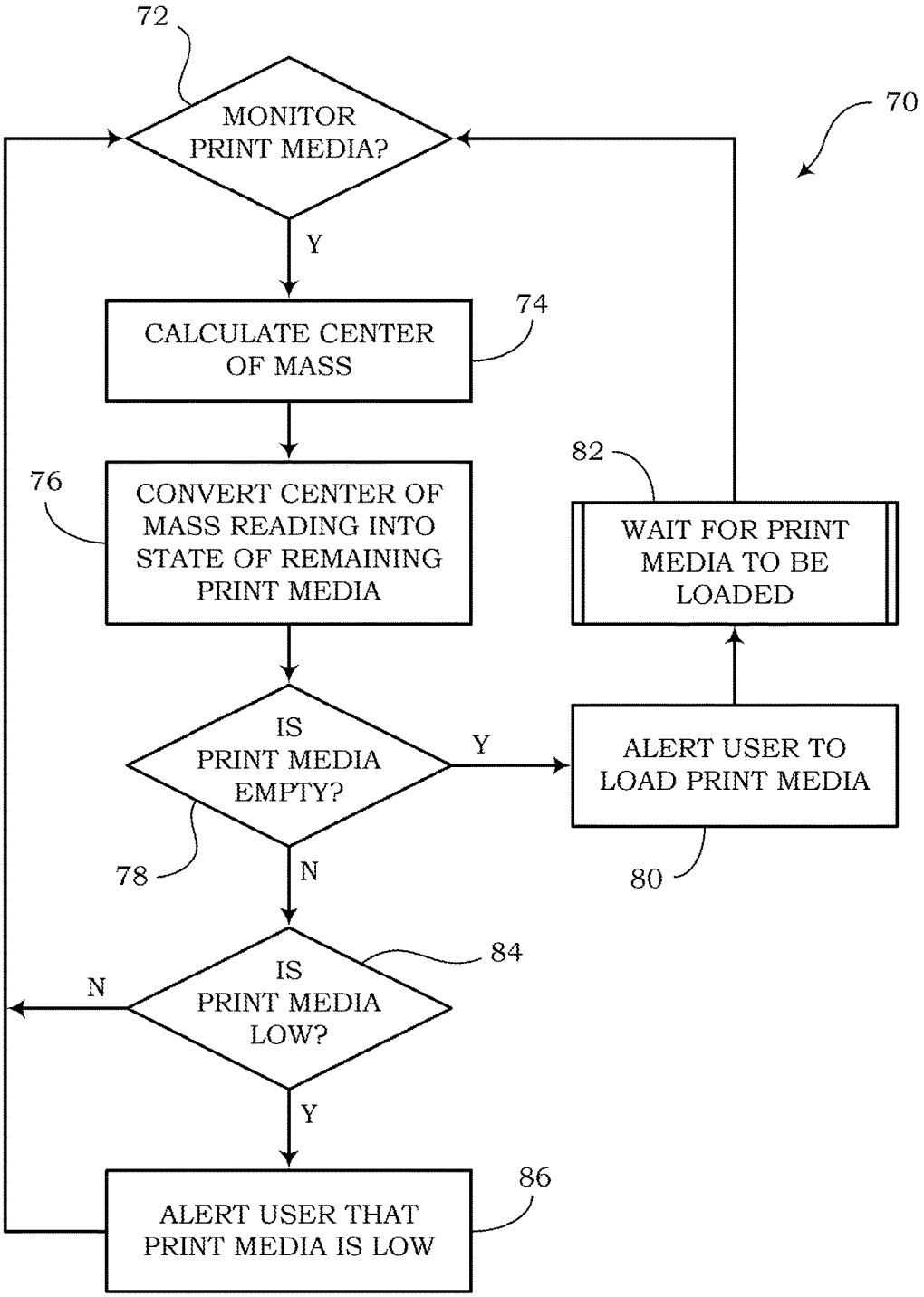
FIG. 10 schematically depicts a flow diagram of a method for indicating when print media needs to be replaced during operation of a mobile printer, according to one embodiment of the present invention.

FIG. 10 is a flow diagram illustrating an embodiment of a method 70 for indicating when print media needs to be replaced during operation of a mobile printer. The method 70 relies on the pre-established reference points calculated in the method 54 of FIG. 9.

The method 70 includes a first decision block 72, which determines when certain conditions are met for monitoring the print media. The print media may be monitored at certain predetermined times or under certain conditions. For example, the print media may be monitored when the mobile printer is first powered on, booted up, or when a user closes the media door. Or the print media may be monitored after a certain number of print jobs have been done. In some cases, the print media may be monitored periodically (e.g., once every one-, five-, ten-minute interval or other suitable time periods). Block 72 may also include determining what type of print media has been installed in the printer Also, decision block 72 may include determining the angular orientation of the mobile printer to determine which set of algorithms and/or reference points to use to monitor the print media. For instance, method 70 may need to compare current calculations with certain reference points that were specifically obtained when the mobile printer was oriented in a horizontal manner or specifically obtained when the mobile printer was oriented in a vertical manner.

It should be noted that, during use, a user of the mobile printer 10 may position the mobile printer 10 at any angle, not just a zero degree horizontal configuration and a 90 degree vertical configuration. Hence, the gyroscopic sensor may be configured to detect any orientation angle. Also, the processing device may be configured to use interpolation or other suitable algorithm if an angle falls between angles at which the initial reference points were obtained. Then, an intermediate reference point (between reference point 26 shown in FIG. 1 and reference point 34 shown in FIG. 3) may be used for monitoring the amount of print media remaining. Therefore, the present invention may use a suitable combination of reference points to monitor the print media.

Furthermore, it should be noted that the mobile printer 10 may be tilted in more than just a pitching angle as illustrated. Instead, the mobile printer 10 may be oriented at any angle with reference to three dimensions. Therefore, the gyroscopic sensor of the present invention may be configured to calculate pitch, roll, and yaw angles of the mobile printer 10. Therefore, the original detection of reference points as described herein may include detection of various print media amounts at multiple sets of angles in three dimensions.

In order for the gyroscopic sensor to operate properly, the mobile printer 10 should be in motion at least for a certain amount of time before the mobile printer 10 is configured to print. Therefore, the media level detection module 20 can detect the pitch, roll, and yaw angles, which can be used for detecting the proper reference points or for calculating (e.g., interpolating) intermediate reference points derived from predetermined reference points.

When it is determined in decision block 72 that the print media is to be monitored, the method 70 proceeds to block 74, which indicates that the center of mass of the mobile printer is calculated. As indicated in block 76, the method 70 includes converting the center of mass reading into a state of remaining print media. For example, the center of mass reading may be compared with the two extreme points obtained with respect to a full state and an empty state. Additionally, if multiple intermediate points are determined in the method 54 of FIG. 9, the center of mass reading may be compared with and/or interpolated with the extreme points and/or intermediate points to determine the remaining amount of the print media. The conversion of center of mass into remaining media amount may be based on the type of print media that is installed in the printer to thereby account for differences in the various masses or densities of different print media that could be used.

The method 70 includes the decision block 78, which determines whether the print media is empty. If empty, the method 70 proceeds to block 80, which indicates that the user is alerted that the print media needs to be loaded into the mobile printer. The method then includes the step of waiting for the print media to be loaded, as indicated in block 82. In some embodiments, waiting for the print media to be loaded may include waiting for the media cover to be opened to allow the print media to be loaded and waiting for the media cover to be closed. The method 70 then returns back to decision block 72 in order that it can be determined whether the print media is to be monitored again.

If it is determined in decision block 78 that the print media is not empty, then the method 70 proceeds to decision block 84, which determines if the print media is low. A low print media state may be determined based on threshold comparisons, which may be part of the step of block 76. If the print media is not low, the method loops back to decision block 72. However, if the media is low, the method proceeds to block 86, which indicates that the user is alerted that the print media is low. The alert may include a visual and/or audible indication for communicating the state of print media.

The step of block 86 may include providing an estimation of the level of print media remaining. For example, one indication may include an alert that the print media is below a certain percentage of full (e.g., below 5%) or may include an alert that the print media can conduct an estimated number of print jobs before running out (e.g., "less than 10 labels remaining" or other indication). In some embodiments, several levels may be detected in a similar manner as diamond 84 and several corresponding alerts can be provided to the user in a similar manner as block 86.

To supplement the present disclosure, this application incorporates entirely by reference the following commonly assigned patents, patent application publications, and patent applications:

U.S. Pat. Nos. 6,832,725; 7,128,266;
7,159,783; 7,413,127;
7,726,575; 8,294,969;
8,317,105; 8,322,622;
8,366,005; 8,371,507;
8,376,233; 8,381,979;
8,390,909; 8,408,464;
8,408,468; 8,408,469;
8,424,768; 8,448,863;
8,457,013; 8,459,557;
8,469,272; 8,474,712;
8,479,992; 8,490,877;
8,517,271; 8,523,076;
8,528,818; 8,544,737;
8,548,242; 8,548,420;
8,550,335; 8,550,354;
8,550,357; 8,556,174;
8,556,176; 8,556,177;
8,559,767; 8,599,957;
8,561,895; 8,561,903;
8,561,905; 8,565,107;
8,571,307; 8,579,200;
8,583,924; 8,584,945;
8,587,595; 8,587,697;
8,588,869; 8,590,789;
8,596,539; 8,596,542;
8,596,543; 8,599,271;
8,599,957; 8,600,158;
8,600,167; 8,602,309;
8,608,053; 8,608,071;
8,611,309; 8,615,487;
8,616,454; 8,621,123;
8,622,303; 8,628,013;
8,628,015; 8,628,016;
8,629,926; 8,630,491;
8,635,309; 8,636,200;
8,636,212; 8,636,215;
8,636,224; 8,638,806;
8,640,958; 8,640,960;
8,643,717; 8,646,692;

8,646,694; 8,657,200; 8,659,397; 8,668,149; 8,678,285; 8,678,286; 8,682,077; 8,687,282; 8,692,927; 8,695,880; 8,698,949; 8,717,494; 8,717,494; 8,720,783; 8,723,804; 8,723,904; 8,727,223; 8,740,082; 8,740,085; 8,746,563; 8,750,445; 8,752,766; 8,756,059; 8,757,495; 8,760,563; 8,763,909; 8,777,108; 8,777,109; 8,779,898; 8,781,520; 8,783,573; 8,789,757; 8,789,758; 8,789,759; 8,794,520; 8,794,522; 8,794,525; 8,794,526; 8,798,367; 8,807,431; 8,807,432; 8,820,630; 8,822,848; 8,824,692; 8,824,696; 8,842,849; 8,844,822; 8,844,823; 8,849,019; 8,851,383; 8,854,633; 8,866,963; 8,868,421; 8,868,519; 8,868,802; 8,868,803; 8,870,074; 8,879,639; 8,880,426; 8,881,983; 8,881,987; 8,903,172; 8,908,995; 8,910,870; 8,910,875; 8,914,290; 8,914,788; 8,915,439; 8,915,444; 8,916,789; 8,918,250; 8,918,564; 8,925,818; 8,939,374; 8,942,480; 8,944,313; 8,944,327; 8,944,332; 8,950,678; 8,967,468; 8,971,346; 8,976,030; 8,976,368; 8,978,981; 8,978,983; 8,978,984; 8,985,456; 8,985,457; 8,985,459; 8,985,461; 8,988,578; 8,988,590; 8,991,704; 8,996,194; 8,996,384; 9,002,641; 9,007,368; 9,010,641; 9,015,513; 9,016,576; 9,022,288; 9,030,964; 9,033,240; 9,033,242; 9,036,054; 9,037,344; 9,038,911; 9,038,915; 9,047,098; 9,047,359; 9,047,420; 9,047,525; 9,047,531; 9,053,055; 9,053,378; 9,053,380; 9,058,526; 9,064,165; 9,064,165; 9,064,167; 9,064,168; 9,064,254; 9,066,032; 9,070,032; 9,076,459; 9,079,423; 9,080,856; 9,082,023; 9,082,031; 9,084,032; 9,087,250; 9,092,681; 9,092,682; 9,092,683; 9,093,141; 9,098,763; 9,104,929; 9,104,934; 9,107,484; 9,111,159; 9,111,166; 9,135,483; 9,137,009; 9,141,839; 9,147,096; 9,148,474; 9,158,000; 9,158,340; 9,158,953; 9,159,059; 9,165,174; 9,171,543; 9,183,425; 9,189,669; 9,195,844; 9,202,458; 9,208,366; 9,208,367; 9,219,836; 9,224,024; 9,224,027; 9,230,140; 9,235,553; 9,239,950; 9,245,492; 9,248,640; 9,250,652; 9,250,712; 9,251,411; 9,258,033; 9,262,633; 9,262,660; 9,262,662; 9,269,036; 9,270,782; 9,274,812; 9,275,388; 9,277,668; 9,280,693; 9,286,496; 9,298,964; 9,301,427; 9,313,377; 9,317,037; 9,319,548; 9,342,723; 9,361,882; 9,365,381; 9,373,018; 9,375,945; 9,378,403; 9,383,848; 9,384,374; 9,390,304; 9,390,596; 9,411,386; 9,412,242; 9,418,269; 9,418,270; 9,465,967; 9,423,318; 9,424,454; 9,436,860; 9,443,123; 9,443,222; 9,454,689; 9,464,885; 9,465,967; 9,478,983; 9,481,186; 9,487,113; 9,488,986; 9,489,782; 9,490,540; 9,491,729; 9,497,092; 9,507,974; 9,519,814; 9,521,331; 9,530,038; 9,572,901; 9,558,386; 9,606,581; 9,646,189; 9,646,191; 9,652,648; 9,652,653; 9,656,487; 9,659,198; 9,680,282; 9,697,401; 9,701,140;

U.S. Design Pat. No. D702,237;
U.S. Design Pat. No. D716,285;
U.S. Design Pat. No. D723,560;
U.S. Design Pat. No. D730,357;
U.S. Design Pat. No. D730,901;
U.S. Design Pat. No. D730,902;
U.S. Design Pat. No. D734,339;
U.S. Design Pat. No. D737,321;
U.S. Design Pat. No. D754,205;
U.S. Design Pat. No. D754,206;
U.S. Design Pat. No. D757,009;
U.S. Design Pat. No. D760,719;
U.S. Design Pat. No. D762,604;
U.S. Design Pat. No. D766,244;
U.S. Design Pat. No. D777,166;
U.S. Design Pat. No. D771,631;
U.S. Design Pat. No. D783,601;
U.S. Design Pat. No. D785,617;

U.S. Design Pat. No. D785,636;
U.S. Design Pat. No. D790,505;
U.S. Design Pat. No. D790,546;
International Publication No. 2013/163789;
U.S. Patent Application Publication No. 2008/0185432;
U.S. Patent Application Publication No. 2009/0134221;
U.S. Patent Application Publication No. 2010/0177080;
U.S. Patent Application Publication No. 2010/0177076;
U.S. Patent Application Publication No. 2010/0177707;
U.S. Patent Application Publication No. 2010/0177749;
U.S. Patent Application Publication No. 2010/0265880;
U.S. Patent Application Publication No. 2011/0202554;
U.S. Patent Application Publication No. 2012/0111946;
U.S. Patent Application Publication No. 2012/0168511;
U.S. Patent Application Publication No. 2012/0168512;
U.S. Patent Application Publication No. 2012/0193423;
U.S. Patent Application Publication No. 2012/0194692;
U.S. Patent Application Publication No. 2012/0203647;
U.S. Patent Application Publication No. 2012/0223141;
U.S. Patent Application Publication No. 2012/0228382;
U.S. Patent Application Publication No. 2012/0248188;
U.S. Patent Application Publication No. 2013/0043312;
U.S. Patent Application Publication No. 2013/0082104;
U.S. Patent Application Publication No. 2013/0175341;
U.S. Patent Application Publication No. 2013/0175343;
U.S. Patent Application Publication No. 2013/0257744;
U.S. Patent Application Publication No. 2013/0257759;
U.S. Patent Application Publication No. 2013/0270346;
U.S. Patent Application Publication No. 2013/0292475;
U.S. Patent Application Publication No. 2013/0292477;
U.S. Patent Application Publication No. 2013/0293539;
U.S. Patent Application Publication No. 2013/0293540;
U.S. Patent Application Publication No. 2013/0306728;
U.S. Patent Application Publication No. 2013/0306731;
U.S. Patent Application Publication No. 2013/0307964;
U.S. Patent Application Publication No. 2013/0308625;
U.S. Patent Application Publication No. 2013/0313324;
U.S. Patent Application Publication No. 2013/0332996;
U.S. Patent Application Publication No. 2014/0001267;
U.S. Patent Application Publication No. 2014/0025584;
U.S. Patent Application Publication No. 2014/0034734;
U.S. Patent Application Publication No. 2014/0036848;
U.S. Patent Application Publication No. 2014/0039693;
U.S. Patent Application Publication No. 2014/0049120;
U.S. Patent Application Publication No. 2014/0049635;
U.S. Patent Application Publication No. 2014/0061306;
U.S. Patent Application Publication No. 2014/0063289;
U.S. Patent Application Publication No. 2014/0066136;
U.S. Patent Application Publication No. 2014/0067692;
U.S. Patent Application Publication No. 2014/0070005;
U.S. Patent Application Publication No. 2014/0071840;
U.S. Patent Application Publication No. 2014/0074746;
U.S. Patent Application Publication No. 2014/0076974;
U.S. Patent Application Publication No. 2014/0097249;
U.S. Patent Application Publication No. 2014/0098792;
U.S. Patent Application Publication No. 2014/0100813;
U.S. Patent Application Publication No. 2014/0103115;
U.S. Patent Application Publication No. 2014/0104413;
U.S. Patent Application Publication No. 2014/0104414;
U.S. Patent Application Publication No. 2014/0104416;
U.S. Patent Application Publication No. 2014/0106725;
U.S. Patent Application Publication No. 2014/0108010;
U.S. Patent Application Publication No. 2014/0108402;
U.S. Patent Application Publication No. 2014/0110485;
U.S. Patent Application Publication No. 2014/0125853;
U.S. Patent Application Publication No. 2014/0125999;
U.S. Patent Application Publication No. 2014/0129378;
U.S. Patent Application Publication No. 2014/0131443;
U.S. Patent Application Publication No. 2014/0133379;
U.S. Patent Application Publication No. 2014/0136208;
U.S. Patent Application Publication No. 2014/0140585;
U.S. Patent Application Publication No. 2014/0152882;
U.S. Patent Application Publication No. 2014/0158770;
U.S. Patent Application Publication No. 2014/0159869;
U.S. Patent Application Publication No. 2014/0166759;
U.S. Patent Application Publication No. 2014/0168787;
U.S. Patent Application Publication No. 2014/0175165;
U.S. Patent Application Publication No. 2014/0191684;
U.S. Patent Application Publication No. 2014/0191913;
U.S. Patent Application Publication No. 2014/0197304;
U.S. Patent Application Publication No. 2014/0214631;
U.S. Patent Application Publication No. 2014/0217166;
U.S. Patent Application Publication No. 2014/0231500;
U.S. Patent Application Publication No. 2014/0247315;
U.S. Patent Application Publication No. 2014/0263493;
U.S. Patent Application Publication No. 2014/0263645;
U.S. Patent Application Publication No. 2014/0270196;
U.S. Patent Application Publication No. 2014/0270229;
U.S. Patent Application Publication No. 2014/0278387;
U.S. Patent Application Publication No. 2014/0288933;
U.S. Patent Application Publication No. 2014/0297058;
U.S. Patent Application Publication No. 2014/0299665;
U.S. Patent Application Publication No. 2014/0332590;
U.S. Patent Application Publication No. 2014/0351317;
U.S. Patent Application Publication No. 2014/0362184;
U.S. Patent Application Publication No. 2014/0363015;
U.S. Patent Application Publication No. 2014/0369511;
U.S. Patent Application Publication No. 2014/0374483;
U.S. Patent Application Publication No. 2014/0374485;
U.S. Patent Application Publication No. 2015/0001301;
U.S. Patent Application Publication No. 2015/0001304;
U.S. Patent Application Publication No. 2015/0009338;
U.S. Patent Application Publication No. 2015/0014416;
U.S. Patent Application Publication No. 2015/0021397;
U.S. Patent Application Publication No. 2015/0028104;
U.S. Patent Application Publication No. 2015/0029002;
U.S. Patent Application Publication No. 2015/0032709;
U.S. Patent Application Publication No. 2015/0039309;
U.S. Patent Application Publication No. 2015/0039878;
U.S. Patent Application Publication No. 2015/0040378;
U.S. Patent Application Publication No. 2015/0049347;
U.S. Patent Application Publication No. 2015/0051992;
U.S. Patent Application Publication No. 2015/0053769;
U.S. Patent Application Publication No. 2015/0062366;
U.S. Patent Application Publication No. 2015/0063215;
U.S. Patent Application Publication No. 2015/0088522;
U.S. Patent Application Publication No. 2015/0096872;
U.S. Patent Application Publication No. 2015/0100196;
U.S. Patent Application Publication No. 2015/0102109;
U.S. Patent Application Publication No. 2015/0115035;
U.S. Patent Application Publication No. 2015/0127791;
U.S. Patent Application Publication No. 2015/0128116;
U.S. Patent Application Publication No. 2015/0133047;
U.S. Patent Application Publication No. 2015/0134470;
U.S. Patent Application Publication No. 2015/0136851;
U.S. Patent Application Publication No. 2015/0142492;
U.S. Patent Application Publication No. 2015/0144692;
U.S. Patent Application Publication No. 2015/0144698;
U.S. Patent Application Publication No. 2015/0149946;
U.S. Patent Application Publication No. 2015/0161429;
U.S. Patent Application Publication No. 2015/0178523;
U.S. Patent Application Publication No. 2015/0178537;
U.S. Patent Application Publication No. 2015/0178685;
U.S. Patent Application Publication No. 2015/0181109;

U.S. Patent Application Publication No. 2015/0199957;
U.S. Patent Application Publication No. 2015/0210199;
U.S. Patent Application Publication No. 2015/0212565;
U.S. Patent Application Publication No. 2015/0213647;
U.S. Patent Application Publication No. 2015/0220753;
U.S. Patent Application Publication No. 2015/0220901;
U.S. Patent Application Publication No. 2015/0227189;
U.S. Patent Application Publication No. 2015/0236984;
U.S. Patent Application Publication No. 2015/0239348;
U.S. Patent Application Publication No. 2015/0242658;
U.S. Patent Application Publication No. 2015/0248572;
U.S. Patent Application Publication No. 2015/0254485;
U.S. Patent Application Publication No. 2015/0261643;
U.S. Patent Application Publication No. 2015/0264624;
U.S. Patent Application Publication No. 2015/0268971;
U.S. Patent Application Publication No. 2015/0269402;
U.S. Patent Application Publication No. 2015/0288689;
U.S. Patent Application Publication No. 2015/0288896;
U.S. Patent Application Publication No. 2015/0310243;
U.S. Patent Application Publication No. 2015/0310244;
U.S. Patent Application Publication No. 2015/0310389;
U.S. Patent Application Publication No. 2015/0312780;
U.S. Patent Application Publication No. 2015/0327012;
U.S. Patent Application Publication No. 2016/0014251;
U.S. Patent Application Publication No. 2016/0025697;
U.S. Patent Application Publication No. 2016/0026838;
U.S. Patent Application Publication No. 2016/0026839;
U.S. Patent Application Publication No. 2016/0040982;
U.S. Patent Application Publication No. 2016/0042241;
U.S. Patent Application Publication No. 2016/0057230;
U.S. Patent Application Publication No. 2016/0062473;
U.S. Patent Application Publication No. 2016/0070944;
U.S. Patent Application Publication No. 2016/0092805;
U.S. Patent Application Publication No. 2016/0101936;
U.S. Patent Application Publication No. 2016/0104019;
U.S. Patent Application Publication No. 2016/0104274;
U.S. Patent Application Publication No. 2016/0109219;
U.S. Patent Application Publication No. 2016/0109220;
U.S. Patent Application Publication No. 2016/0109224;
U.S. Patent Application Publication No. 2016/0112631;
U.S. Patent Application Publication No. 2016/0112643;
U.S. Patent Application Publication No. 2016/0117627;
U.S. Patent Application Publication No. 2016/0124516;
U.S. Patent Application Publication No. 2016/0125217;
U.S. Patent Application Publication No. 2016/0125342;
U.S. Patent Application Publication No. 2016/0125873;
U.S. Patent Application Publication No. 2016/0133253;
U.S. Patent Application Publication No. 2016/0171597;
U.S. Patent Application Publication No. 2016/0171666;
U.S. Patent Application Publication No. 2016/0171720;
U.S. Patent Application Publication No. 2016/0171775;
U.S. Patent Application Publication No. 2016/0171777;
U.S. Patent Application Publication No. 2016/0174674;
U.S. Patent Application Publication No. 2016/0178479;
U.S. Patent Application Publication No. 2016/0178685;
U.S. Patent Application Publication No. 2016/0178707;
U.S. Patent Application Publication No. 2016/0179132;
U.S. Patent Application Publication No. 2016/0179143;
U.S. Patent Application Publication No. 2016/0179368;
U.S. Patent Application Publication No. 2016/0179378;
U.S. Patent Application Publication No. 2016/0180130;
U.S. Patent Application Publication No. 2016/0180133;
U.S. Patent Application Publication No. 2016/0180136;
U.S. Patent Application Publication No. 2016/0180594;
U.S. Patent Application Publication No. 2016/0180663;
U.S. Patent Application Publication No. 2016/0180678;
U.S. Patent Application Publication No. 2016/0180713;
U.S. Patent Application Publication No. 2016/0185136;
U.S. Patent Application Publication No. 2016/0185291;
U.S. Patent Application Publication No. 2016/0186926;
U.S. Patent Application Publication No. 2016/0188861;
U.S. Patent Application Publication No. 2016/0188939;
U.S. Patent Application Publication No. 2016/0188940;
U.S. Patent Application Publication No. 2016/0188941;
U.S. Patent Application Publication No. 2016/0188942;
U.S. Patent Application Publication No. 2016/0188943;
U.S. Patent Application Publication No. 2016/0188944;
U.S. Patent Application Publication No. 2016/0189076;
U.S. Patent Application Publication No. 2016/0189087;
U.S. Patent Application Publication No. 2016/0189088;
U.S. Patent Application Publication No. 2016/0189092;
U.S. Patent Application Publication No. 2016/0189284;
U.S. Patent Application Publication No. 2016/0189288;
U.S. Patent Application Publication No. 2016/0189366;
U.S. Patent Application Publication No. 2016/0189443;
U.S. Patent Application Publication No. 2016/0189447;
U.S. Patent Application Publication No. 2016/0189489;
U.S. Patent Application Publication No. 2016/0192051;
U.S. Patent Application Publication No. 2016/0202951;
U.S. Patent Application Publication No. 2016/0202958;
U.S. Patent Application Publication No. 2016/0202959;
U.S. Patent Application Publication No. 2016/0203021;
U.S. Patent Application Publication No. 2016/0203429;
U.S. Patent Application Publication No. 2016/0203797;
U.S. Patent Application Publication No. 2016/0203820;
U.S. Patent Application Publication No. 2016/0204623;
U.S. Patent Application Publication No. 2016/0204636;
U.S. Patent Application Publication No. 2016/0204638;
U.S. Patent Application Publication No. 2016/0227912;
U.S. Patent Application Publication No. 2016/0232891;
U.S. Patent Application Publication No. 2016/0292477;
U.S. Patent Application Publication No. 2016/0294779;
U.S. Patent Application Publication No. 2016/0306769;
U.S. Patent Application Publication No. 2016/0314276;
U.S. Patent Application Publication No. 2016/0314294;
U.S. Patent Application Publication No. 2016/0316190;
U.S. Patent Application Publication No. 2016/0323310;
U.S. Patent Application Publication No. 2016/0325677;
U.S. Patent Application Publication No. 2016/0327614;
U.S. Patent Application Publication No. 2016/0327930;
U.S. Patent Application Publication No. 2016/0328762;
U.S. Patent Application Publication No. 2016/0330218;
U.S. Patent Application Publication No. 2016/0343163;
U.S. Patent Application Publication No. 2016/0343176;
U.S. Patent Application Publication No. 2016/0364914;
U.S. Patent Application Publication No. 2016/0370220;
U.S. Patent Application Publication No. 2016/0372282;
U.S. Patent Application Publication No. 2016/0373847;
U.S. Patent Application Publication No. 2016/0377414;
U.S. Patent Application Publication No. 2016/0377417;
U.S. Patent Application Publication No. 2017/0010141;
U.S. Patent Application Publication No. 2017/0010328;
U.S. Patent Application Publication No. 2017/0010780;
U.S. Patent Application Publication No. 2017/0016714;
U.S. Patent Application Publication No. 2017/0018094;
U.S. Patent Application Publication No. 2017/0046603;
U.S. Patent Application Publication No. 2017/0047864;
U.S. Patent Application Publication No. 2017/0053146;
U.S. Patent Application Publication No. 2017/0053147;
U.S. Patent Application Publication No. 2017/0053647;
U.S. Patent Application Publication No. 2017/0055606;
U.S. Patent Application Publication No. 2017/0060316;
U.S. Patent Application Publication No. 2017/0061961;
U.S. Patent Application Publication No. 2017/0064634;

U.S. Patent Application Publication No. 2017/0083730;
U.S. Patent Application Publication No. 2017/0091502;
U.S. Patent Application Publication No. 2017/0091706;
U.S. Patent Application Publication No. 2017/0091741;
U.S. Patent Application Publication No. 2017/0091904;
U.S. Patent Application Publication No. 2017/0092908;
U.S. Patent Application Publication No. 2017/0094238;
U.S. Patent Application Publication No. 2017/0098947;
U.S. Patent Application Publication No. 2017/0100949;
U.S. Patent Application Publication No. 2017/0108838;
U.S. Patent Application Publication No. 2017/0108895;
U.S. Patent Application Publication No. 2017/0118355;
U.S. Patent Application Publication No. 2017/0123598;
U.S. Patent Application Publication No. 2017/0124369;
U.S. Patent Application Publication No. 2017/0124396;
U.S. Patent Application Publication No. 2017/0124687;
U.S. Patent Application Publication No. 2017/0126873;
U.S. Patent Application Publication No. 2017/0126904;
U.S. Patent Application Publication No. 2017/0139012;
U.S. Patent Application Publication No. 2017/0140329;
U.S. Patent Application Publication No. 2017/0140731;
U.S. Patent Application Publication No. 2017/0147847;
U.S. Patent Application Publication No. 2017/0150124;
U.S. Patent Application Publication No. 2017/0169198;
U.S. Patent Application Publication No. 2017/0171035;
U.S. Patent Application Publication No. 2017/0171703;
U.S. Patent Application Publication No. 2017/0171803;
U.S. Patent Application Publication No. 2017/0180359;
U.S. Patent Application Publication No. 2017/0180577;
U.S. Patent Application Publication No. 2017/0181299;
U.S. Patent Application Publication No. 2017/0190192;
U.S. Patent Application Publication No. 2017/0193432;
U.S. Patent Application Publication No. 2017/0193461;
U.S. Patent Application Publication No. 2017/0193727;
U.S. Patent Application Publication No. 2017/0199266;
U.S. Patent Application Publication No. 2017/0200108; and
U.S. Patent Application Publication No. 2017/0200275.

In the specification and/or figures, typical embodiments of the invention have been disclosed. The present invention is not limited to such exemplary embodiments. The use of the term "and/or" includes any and all combinations of one or more of the associated listed items. The figures are schematic representations and so are not necessarily drawn to scale. Unless otherwise noted, specific terms have been used in a generic and descriptive sense and not for purposes of limitation.

The invention claimed is:

1. A method comprising the steps of:

detecting, by a media level detection module within a housing of a mobile printer, a first center of mass of the mobile printer based on a first signal from a sensor, the mobile printer comprising print media; and determining, by the media level detection module, a remaining print media level based on comparing the first sensor signal indicating the first center of mass of the mobile printer to a second sensor signal indicating a second center of mass of the mobile printer associated with empty print media level and a third sensor signal indicating a third center of mass of the mobile printer associated with a full print media level.

2. The method of claim 1, further comprising the step of determining, by the media level detection module, consumption of the print media based on a change of the center of mass of the mobile printer, wherein the change of center of mass of the mobile printer results from a redistribution of weight of the mobile printer due to consumption of the print media.

3. The method of claim 2, further comprising the step of determining, by the media level detection module, the change in the center of mass of the mobile printer is configured to change from a first point to a second point, wherein the first point corresponds to a condition in which the mobile printer contains a maximum amount of print media and the second point corresponds to a condition in which the mobile printer contains a minimum amount of print media.

4. The method of claim 1, further comprising the step of detecting, by a gyroscope and/or an accelerometer housed within the mobile printer, the center of mass of the mobile printer.

5. The method of claim 4, further comprising the step of determining, by the gyroscope and/or the accelerometer, an orientation of the mobile printer.

6. The method of claim 1, further comprising the steps of:

detecting, by the media level detection module, an orientation of the mobile printer; and determining, by the media level detection module, the remaining print media level based on the detected center of mass and the orientation.

7. The method of claim 1, further comprising the step of providing, by the media level detection module, an indication of the remaining print media level.

8. The method of claim 7, further comprising the step of providing, by the media level detection module, a warning if the remaining print media level falls below a predetermined threshold.

9. A printer comprising:

a housing;

a printing mechanism mounted within the housing, the printing mechanism configured to print onto a print media; and a media level detection module mounted within the housing, the media level detection module configured to:

detect the center of mass of the printer based on a first signal from a sensor; and determine a remaining print media level by comparing the first sensor signal indicating a first center of mass of the printer to a second sensor signal indicating a second center of mass of the printer associated with empty print media level and a third sensor signal indicating a third center of mass of the printer associated with a full print media level.

10. The printer of claim 9, wherein the media level detection module is further configured to determine consumption of the print media based on a change of center of mass of the printer resulting from a redistribution of weight of the mobile printer based on consumption of the print media.

11. The printer of claim 10, wherein the media level detection module is further configured to determine the change in the center of mass of the printer from a first point to a second point, wherein the first point corresponds to a condition in which the printer contains a maximum amount of print media and the second point corresponds to a condition in which the printer contains a minimum amount of print media.

12. The printer of claim 9, wherein the media level detection module comprises a gyroscope and/or an accelerometer.

13. The printer of claim 12, wherein the gyroscope and/or accelerometer are configured to determine an orientation of the printer, and wherein the media level detection module is configured to determine the remaining print media level based on the detected center of mass and the orientation.

14. The printer of claim 9, wherein the printer is a mobile printer.

15. The printer of claim 9, further comprising an interface configured to provide an indication of the remaining print media level.

16. The printer of claim 9, wherein the center of mass of the print media is offset from the center of mass of the printer.

17. A device configured to use a consumable resource, the device comprising:

a housing that includes a containment area where the consumable resource is to be stored; and a detection module configured to:

detect the center of mass of the device based on a first signal from a sensor; and determine a remaining level of the consumable resource by comparing the first sensor signal indicating a first center of mass of the device to a second sensor signal indicating a second center of mass of the device associated with empty consumable resource level and a third sensor signal indicating a third center of mass of the device associated with a full consumable resource level.

18. The device of claim 17, wherein the first sensor comprises a gyroscope and/or an accelerometer configured to detect the center of mass of the device.

19. The device of claim 18, wherein the gyroscope and/or accelerometer are configured to detect an orientation of the device and determine the remaining level based on the detected center of mass and the orientation.

20. The device of claim 17, wherein the device is a mobile printer and the consumable resource is paper or labels.

* * * * *